US006386543B1

(12) United States Patent
Luker

(10) Patent No.: US 6,386,543 B1
(45) Date of Patent: May 14, 2002

(54) DOUBLE CROSTIC TECHNIQUES

(76) Inventor: Kenneth Luker, 1391 S. 9th East, Salt Lake City, UT (US) 84105

( * ) Notice: Subject to any disclaimer, the term of this patent is extended or adjusted under 35 U.S.C. 154(b) by 0 days.

(21) Appl. No.: 09/502,972

(22) Filed: Feb. 11, 2000

Related U.S. Application Data

(60) Provisional application No. 60/119,831, filed on Feb. 12, 1999.

(51) Int. Cl.[7] ..... A63F 3/00

(52) U.S. Cl. ..... 273/272; 273/292; 273/299; 273/153 R; 463/9

(58) Field of Search ..... 463/1, 9, 43; 273/292, 273/272, 299, 300, 460–461, 153 R; 434/159, 161, 322

(56) References Cited

U.S. PATENT DOCUMENTS

| | | | | |
|---|---|---|---|---|
| 3,117,789 A | * | 1/1964 | Wiebe | 273/130 |
| 3,152,806 A | | 10/1964 | Jackman | 273/135 |
| 3,393,914 A | | 7/1968 | Hill | 273/135 |
| 3,524,648 A | | 8/1970 | Nilan | 273/153 |
| 3,891,218 A | * | 6/1975 | Hilgartner et al. | 273/130 E |
| 4,215,864 A | * | 8/1980 | Nichols | 273/153 R |
| 4,509,758 A | * | 4/1985 | Cole | 273/240 |
| 4,687,201 A | * | 8/1987 | Riviera | 273/153 R |
| 4,789,162 A | * | 12/1988 | Harris | 273/272 |
| 5,338,043 A | | 8/1994 | Rehm | 273/272 |
| 5,479,506 A | | 12/1995 | Rehm | 380/1 |
| 5,667,438 A | | 9/1997 | Rehm | 463/9 |
| 5,740,243 A | | 4/1998 | Rehm | 380/1 |

OTHER PUBLICATIONS

"Enigmacross for Windows". Acrostic Puzzle Software by Crossdown: http://www.netacc.net/~crossdwn/AboutEnigmacross.html.

E–Crostic Software: http://www.teleport.com/~howorth/e–crostic/e–crostic.html.

Nilan, John O. *Alphabok*. Springbok Editions, Inc. New York, NY 1968.

* cited by examiner

*Primary Examiner*—Michael O'Neill
*Assistant Examiner*—Scott E. Jones
(74) *Attorney, Agent, or Firm*—TraskBritt, P.C.

(57) ABSTRACT

The present invention generally involves a computer program for creating, printing, storing, organizing, solving and publicizing double crostic puzzles and playing a solitaire game based upon the double crostic puzzle theme. The computer program allows a user to create or solve double crostic puzzles with minimal effort because the computer program accomplishes the "book keeping" and layout requirements of a double crostic puzzle. In addition, the computer program may be used as a solitaire game wherein the user attempts to create a puzzle from a preselected letter bank.

18 Claims, 28 Drawing Sheets

1 V 2 T 3 F 4 L 5 J 6 G 7 N 8 B 9 S 10 X 11 B 12 K 13 P 14 K 15 G 16 N 17 S 18 G

19 U 20 U 21 G 22 Q 23 T 24 R 25 R 26 B 27 J 28 U 29 S 30 L 31 L 32 Y 33 F 34 M 35 Q 36 J

37 R 38 G 39 Q 40 S 41 U 42 P 43 O 44 L 45 E 46 V 47 W 48 V 49 W 50 W 51 H 52 U 53 P 54 I

55 F 56 J 57 M 58 M 59 Y 60 T 61 B 62 T 63 J 64 A 65 A 66 M 67 T 68 R 69 C 70 W 71 S 72 L

73 D 74 J 75 I 76 X 77 F 78 N 79 H 80 D 81 I 82 L 83 G 84 E 85 Y 86 A 87 H 88 I 89 Y 90 O

91 N 92 K 93 Y 94 D 95 X 96 Q 97 P 98 O 99 N 100 U 101 F 102 E 103 A 104 P 105 D 106 C 107 Q 108 S

109 U 110 O 111 I 112 R 113 W 114 U 115 G 116 F 117 R 118 E 119 I 120 F 121 W 122 G 123 X 124 X 125 A

126 O 127 M 128 P 129 F 130 C 131 J 132 B 133 P 134 N 135 Q 136 C 137 D 138 W 139 K 140 B 141 U

510

80 8 105 137 84 3 15 87 75 36 139 44 67 99 43 53 22 68 40 62 100 91 49 10 85

500

CLUES:

520

A. 88 65 103 125 64
Stingy

B. 8 11 140 26 132 61
Utah town near Price

C. 106 130 69 136
Notion

D. 137 105 73 80 94
Swallow-like bird

E. 84 102 118 45
High-School Subject

F. 3 129 120 33 55 77 116 101
Chicago locale

G. 15 21 122 83 115 18 38 6
Opposite of word A

H. 87 79 51
Fifties school dance

I. 75 54 111 81 88 119
Walk Noiselessly or carefully

J. 36 63 74 27 5 131 56
Prominent Christian persuasion

K. 139 14 12 92
Kind of chair or street

L. 44 82 30 72 4 31
Desire for liquid

M. 57 127 66 58 34
Where someone might claim to live

530

N. 99 134 16 78 7
It happens

O. 43 126 90 98 110
Marsh

P. 53 97 42 13 128 133 104
Obliteration

Q. 22 135 39 107 35 95
Settle in softly

R. 68 112 37 117 24 25
All the world is sad and _____...

S. 40 17 71 108 9 29
Scribed

T. 62 67 60 23 2
Extend to

U. 100 114 28 20 41 19 109 52 141
Kind of pen-point

V. 91 46 48 1
Statement to a line-stander

W. 49 138 47 70 113 50 121
Inspiring

X. 10 76 123 95 124
Power

Y. 85 59 89 93 32
Provide with a resource

FIG. 1

| | | | | | | | | | | | | | | | | | |
|---|---|---|---|---|---|---|---|---|---|---|---|---|---|---|---|---|---|
| T | H | I | S | I | S | T | H | E | M | E | S | S | A | G | E | T | O |
| 1 V | 2 T | 3 F | 4 L | 5 J | 6 G | 7 N | 8 B | 9 S | 10 X | 11 B | 12 K | 13 P | 14 K | 15 G | 16 N | 17 S | 18 G |
| B | E | E | N | C | R | Y | P | T | E | E | I | T | W | I | L | L | B |
| 19 U | 20 U | 21 G | 22 Q | 23 T | 24 R | 25 R | 26 B | 27 J | 28 U | 29 S | 30 L | 31 L | 32 Y | 33 F | 34 M | 35 Q | 36 J |
| E | U | S | E | D | A | S | T | H | E | E | X | A | M | P | L | E | I |
| 37 R | 38 G | 39 Q | 40 S | 41 U | 42 P | 43 O | 44 L | 45 E | 46 V | 47 W | 48 V | 49 W | 50 W | 51 H | 52 U | 53 P | 54 I |
| N | T | H | E | N | A | R | R | A | T | I | V | E | D | E | S | C | R |
| 55 F | 56 J | 57 M | 58 M | 59 Y | 60 T | 61 B | 62 T | 63 J | 64 A | 65 A | 66 M | 67 T | 68 R | 69 C | 70 W | 71 S | 72 L |
| I | P | T | I | O | N | O | F | T | H | E | M | E | T | H | O | D | A |
| 73 D | 74 J | 75 I | 76 X | 77 F | 78 N | 79 H | 80 D | 81 I | 82 L | 83 G | 84 E | 85 Y | 86 A | 87 H | 88 I | 89 Y | 90 O |
| N | Y | O | T | H | E | R | M | E | S | S | A | G | E | W | I | T | H |
| 91 N | 92 K | 93 Y | 94 D | 95 X | 96 Q | 97 P | 98 O | 99 N | 100 U | 101 F | 102 E | 103 A | 104 P | 105 D | 106 C | 107 Q | 108 S |
| A | P | P | R | O | P | R | I | A | T | E | L | E | N | G | T | H | |
| 109 U | 110 O | 111 I | 112 R | 113 W | 114 U | 115 G | 116 F | 117 R | 118 E | 119 I | 120 F | 121 W | 122 G | 123 X | 124 X | 125 A | |
| W | O | U | L | D | S | E | R | V | E | A | S | W | E | L | L | | |
| 126 O | 127 M | 128 P | 129 F | 130 C | 131 J | 132 B | 133 P | 134 N | 135 Q | 136 C | 137 D | 138 W | 139 K | 140 B | 141 U | | |

510

| | | | | | | | | | | | | | | | | | | | | | | | |
|---|---|---|---|---|---|---|---|---|---|---|---|---|---|---|---|---|---|---|---|---|---|---|---|
| T | H | I | S | M | I | G | H | T | B | E | T | H | E | S | E | N | D | E | R | S | N | A | M | E |
| 80 | 8 | 105 | 137 | 84 | 3 | 15 | 87 | 75 | 36 | 139 | 44 | 67 | 99 | 43 | 53 | 22 | 68 | 40 | 62 | 100 | 91 | 49 | 10 | 85 |

500

520

CLUES:

A. T I G H T
88 65 103 125 64
Stingy

B. H E L P E R
8 11 140 26 132 61
Utah town near Price

C. I D E A
106 130 69 136
Notion

D. S W I F T
137 105 73 80 94
Swallow-like bird

E. M A T H
84 102 118 45
High-School Subject

F. I L L I N O I S
3 129 120 33 55 77 116 101
Chicago locale

G. G E N E R O U S
15 21 122 83 115 18 38 6
Opposite of word A

H. H O P
87 79 51
Fifties school dance

I. T I P T O E
75 54 111 81 88 119
Walk Noiselessly or carefully

J. B A P T I S T
36 63 74 27 5 131 56
Prominent Christian persuasion

K. E A S Y
139 14 12 92
Kind of chair or street

L. T H I R S T
44 82 30 72 4 31
Desire for liquid

M. H O V E L
57 127 66 58 34
Where someone might claim to live

N. E V E N T
99 134 16 78 7
It happens

530

O. S W A M P
43 126 90 98 110
Marsh

P. E R A S U R E
53 97 42 13 128 133 104
Obliteration

Q. N E S T L E
22 135 39 107 35 95
Settle in softly

R. D R E A R Y
68 112 37 117 24 25
All the world is sad and _____...

S. E T C H E D
40 17 71 108 9 29
Scribed

T. R E A C H
62 67 60 23 2
Extend to

U. S P E E D A L L
100 114 28 20 41 19 109 52 141
Kind of pen-point

V. N E X T
91 46 48 1
Statement to a line-stander

W. A W E S O M E
49 138 47 70 113 50 121
Inspiring

X. M I G H T
10 76 123 95 124
Power

Y. E N D O W
85 59 89 93 32
Provide with a resource

FIG. 2

| | | | | | | | | | | | | | | | | | | | | | |
|---|---|---|---|---|---|---|---|---|---|---|---|---|---|---|---|---|---|---|---|---|---|
| 1 V | 2 T | 3 F | 4 L | ****** ****** ****** | 5 J | 6 G | ***** ***** ***** | 7 N | 8 B | 9 S | ***** ***** ***** | 10 X | 11 B | 12 K | 13 P | 14 K | 15 G | 16 N | ***** ***** ***** | 17 S | 18 G |
| ***** ***** ***** | 19 U | 20 U | ***** ***** ***** | 21 G | 22 Q | 23 T | 24 R | 25 R | 26 B | 27 J | 28 U | 29 S | ***** ***** ***** | 30 L | 31 L | ***** ***** ***** | 32 Y | 33 F | 34 M | 35 Q | ****** ****** ****** |
| 36 J | 37 R | ***** ***** ***** | 38 G | 39 Q | 40 S | 41 U | ***** ***** ***** | 42 P | 43 O | ***** ***** ***** | 44 L | 45 E | 46 V | ***** ***** ***** | 47 W | 48 V | 49 W | 50 W | 51 H | 52 U | 53 P |
| ***** ***** ***** | 54 I | 55 F | ***** ***** ***** | 56 J | 57 M | 58 M | ***** ***** ***** | 59 Y | 60 T | 61 B | 62 T | 63 J | 64 A | 65 A | 66 M | 67 T | ***** ***** ***** | 68 R | 69 C | 70 W | 71 S |
| 72 L | 73 D | 74 J | 75 I | 76 X | 77 F | 78 N | ***** ***** ***** | 79 H | 80 D | ***** ***** ***** | 81 B | 82 L | 83 G | ***** ***** ***** | 84 E | 85 Y | 86 A | 87 H | 88 I | 89 Y | ****** ****** ****** |
| 90 O | 91 V | 92 K | ***** ***** ***** | 93 Y | 94 D | 95 X | 96 Q | 97 P | ***** ***** ***** | 98 O | 99 N | 100 U | 101 F | 102 E | 103 A | 104 P | ***** ***** ***** | 105 D | 106 C | 107 Q | 108 S |
| ***** ***** ***** | 109 U | 110 O | 111 I | 112 R | 113 W | 114 U | 115 G | 116 F | 117 R | 118 E | 119 I | ***** ***** ***** | 120 F | 121 W | 122 G | 123 X | 124 X | 125 A | ***** ***** ***** | 126 O | 127 M |
| 128 P | 129 F | 130 C | ***** ***** ***** | 131 J | 132 B | 133 P | 134 N | 135 Q | ***** ***** ***** | 136 C | 137 D | ***** ***** ***** | 138 W | 139 K | 140 B | 141 U | ***** ***** ***** | ***** ***** ***** | ***** ***** ***** | ***** ***** ***** | ****** ****** ****** |

Directions:
Each number in the clues stands for one letter in an answer word, and also corresponds to one square in the grid. As you answer the clues, transfer each letter to the same-numbered square in the grid. As a message grows in the grid, you can guess other words in the message. Transfer each guessed letter back to the clue indicated by its square. When you are done, the first letters of the answers will form a note about the message.

FIG. 4A

CLUES:

A.
88 65 103 125 64
Stingy

B.
8 11 140 26 132 61
Utah town near Price

C.
106 130 69 136
Notion

D.
137 105 73 80 94
Swallow-like bird

E.
84 102 118 45
High-School Subject

F.
3 129 120 33 55 77 116 101
Chicago locale

G.
15 21 122 83 115 18 38 6
Opposite of word A

H.
87 79 51
Fifties school dance

I.
75 54 111 81 88 119
Walk Noiselessly or carefully

J.
36 63 74 27 5 131 56
Prominent Christian persuasion

K.
139 14 12 92
Kind of chair or street

L.
44 82 30 72 4 31
Desire for liquid

FIG. 4B

M.

57 127 66 58 34

Where someone might claim to live

N.

99 134 16 78 7

It happens

O.

43 126 90 98 110

Marsh

P.

53 97 42 13 128 133 104

Obliteration

Q.

22 135 39 107 35 95

Settle in softly

R.

68 112 37 117 24 25

All the world is sad and _____...

S.

40 17 71 108 9 29

Scribed

T.

62 67 60 23 2

Extend to

U.

100 114 28 20 41 19 109 52 141

Kind of pen-point

V.

91 46 48 1

Statement to a line-stander

W.

49 138 47 70 113 50 121

Inspiring

X.

10 76 123 95 124

Power

Y.

85 59 89 93 32

Provide with a resource

FIG 4C

| | | | | | | | | | | | | | | | | | | | | | |
|---|---|---|---|---|---|---|---|---|---|---|---|---|---|---|---|---|---|---|---|---|---|
| 1 V<br>T | 2 T<br>H | 3 F<br>I | 4 L<br>S | ******<br>******<br>****** | 5 J<br>I | 6 G<br>S | *****<br>*****<br>***** | 7 N<br>T | 8 B<br>H | 9 S<br>E | *****<br>*****<br>***** | 10 X<br>M | 11 B<br>E | 12 K<br>S | 13 P<br>S | 14 K<br>A | 15 G<br>G | 16 N<br>E | *****<br>*****<br>***** | 17 S<br>T | 18 G<br>O |
| *****<br>*****<br>***** | 19 U<br>B | 20 U<br>E | *****<br>*****<br>***** | 21 G<br>E | 22 Q<br>N | 23 T<br>C | 24 R<br>R | 25 R<br>Y | 26 B<br>P | 27 J<br>T | 28 U<br>E | 29 S<br>D | *****<br>*****<br>***** | 30 L<br>I | 31 L<br>T | *****<br>*****<br>***** | 32 Y<br>W | 33 F<br>I | 34 M<br>L | 35 Q<br>L | ******<br>******<br>****** |
| 36 J<br>B | 37 R<br>E | *****<br>*****<br>***** | 38 G<br>U | 39 Q<br>S | 40 S<br>E | 41 U<br>D | *****<br>*****<br>***** | 42 P<br>A | 43 O<br>S | *****<br>*****<br>***** | 44 L<br>T | 45 E<br>H | 46 V<br>E | *****<br>*****<br>***** | 47 W<br>E | 48 V<br>X | 49 W<br>A | 50 W<br>M | 51 H<br>P | 52 U<br>L | 53 P<br>E |
| *****<br>*****<br>***** | 54 I<br>I | 55 F<br>N | *****<br>*****<br>***** | 56 J<br>T | 57 M<br>H | 58 M<br>E | *****<br>*****<br>***** | 59 Y<br>N | 60 T<br>A | 61 B<br>R | 62 T<br>R | 63 J<br>A | 64 A<br>T | 65 A<br>I | 66 M<br>V | 67 T<br>E | *****<br>*****<br>***** | 68 R<br>D | 69 C<br>E | 70 W<br>S | 71 S<br>C |
| 72 L<br>R | 73 D<br>I | 74 J<br>P | 75 I<br>T | 76 X<br>I | 77 F<br>O | 78 N<br>N | *****<br>*****<br>***** | 79 H<br>O | 80 D<br>F | *****<br>*****<br>***** | 81 B<br>T | 82 L<br>H | 83 G<br>E | *****<br>*****<br>***** | 84 E<br>M | 85 Y<br>E | 86 A<br>T | 87 H<br>H | 88 I<br>O | 89 Y<br>D | ******<br>******<br>****** |
| 90 O<br>A | 91 V<br>N | 92 K<br>Y | *****<br>*****<br>***** | 93 Y<br>O | 94 D<br>T | 95 X<br>H | 96 Q<br>E | 97 P<br>R | *****<br>*****<br>***** | 98 O<br>M | 99 N<br>E | 100 U<br>S | 101 F<br>S | 102 E<br>A | 103 A<br>G | 104 P<br>E | *****<br>*****<br>***** | 105 D<br>W | 106 C<br>I | 107 Q<br>T | 108 S<br>H |
| *****<br>*****<br>***** | 109 U<br>A | 110 O<br>P | 111 I<br>P | 112 R<br>R | 113 W<br>O | 114 U<br>P | 115 G<br>R | 116 F<br>I | 117 R<br>A | 118 E<br>T | 119 I<br>E | *****<br>*****<br>***** | 120 F<br>L | 121 W<br>E | 122 G<br>N | 123 X<br>G | 124 X<br>T | 125 A<br>H | *****<br>*****<br>***** | 126 O<br>W | 127 M<br>O |
| 128 P<br>U | 129 F<br>L | 130 C<br>D | *****<br>*****<br>***** | 131 J<br>S | 132 B<br>E | 133 P<br>R | 134 N<br>V | 135 Q<br>E | *****<br>*****<br>***** | 136 C<br>A | 137 D<br>S | *****<br>*****<br>***** | 138 W<br>W | 139 K<br>E | 140 B<br>L | 141 U<br>L | *****<br>*****<br>***** | *****<br>*****<br>***** | *****<br>*****<br>***** | *****<br>*****<br>***** | ******<br>******<br>****** |

Answer key: The answers and cell numbers are on the first two lines.
The clue is on the third line.

FIG. 5A

M. HOVEL
57 127 66 58 34
Where someone might claim to live

N. EVENT
99 134 16 78 7
It happens

O. SWAMP
43 126 90 98 110
Marsh

P. ERASURE
53 97 42 13 128 133 104
Obliteration

Q. NESTLE
22 135 39 107 35 95
Settle in softly

R. DREARY
68 112 37 117 24 25
All the world is sad and _____...

S. ETCHED
40 17 71 108 9 29
Scribed

T. REACH
62 67 60 23 2
Extend to

U. SPEEDBALL
100 114 28 20 41 19 109 52 141
Kind of pen-point

V. NEXT
91 46 48 1
Statement to a line-stander

W. AWESOME
49 138 47 70 113 50 121
Inspiring

X. MIGHT
10 76 123 95 124
Power

Y. ENDOW
85 59 89 93 32
Provide with a resource

FIG 5B

CLUES:

A. TIGHT
88 65 103 125 64
Stingy

B. HELPER
8 11 140 26 132 61
Utah town near Price

C. IDEA
106 130 69 136
Notion

D. SWIFT
137 105 73 80 94
Swallow-like bird

E. MATH
84 102 118 45
High-School Subject

F. ILLINOIS
3 129 120 33 55 77 116 101
Chicago locale

G. GENEROUS
15 21 122 83 115 18 38 6
Opposite of word A

H. HOP
87 79 51
Fifties school dance

I. TIPTOE
75 54 111 81 88 119
Walk Noiselessly or carefully

J. BAPTIST
36 63 74 27 5 131 56
Prominent Christian persuasion

K. EASY
139 14 12 92
Kind of chair or street

L. THIRST
44 82 30 72 4 31
Desire for liquid

FIG. 5C

A. T
B. H
C. I
D. S
E. M
F. I
G. GENEROUS
H. H
I. TIPTOE
J. B
K. EASY
L. T
M. H
N. E
O. SWAMP
P. E
Q. N

R. D
S. E
T. R
U. SPEEDBALL
V. N
W. A
X. M
Y. E

| | | | |
|---|---|---|---|
| A | 6 | N | 3 |
| B | | O | 5 |
| C | 2 | P | 3 |
| D | 4 | Q | |
| E | 14 | R | 6 |
| F | 1 | S | 6 |
| G | 2 | T | 11 |
| H | 6 | U | 1 |
| I | 7 | V | 2 |
| J | | W | 3 |
| K | | X | 1 |
| L | 5 | Y | 1 |
| M | 1 | Z | |

PRESS '*' IF YOU ARE FINISHED, '0' TO SAVE 'TIL LATER
OR CHOOSE THE WORD YOU WANT TO CREATE?

FIG. 7

A. TIGHT
B. HELPER
C. IDEA
D. SWIFT
E. MATH
F. ILLINOIS
G. GENEROUS
H. HOP
I. TIPTOE
J. BAPTIST
K. EASY
L. THIRST
M. HOVEL
N. EVENT
O. SWAMP
P. ERASURE
Q. NESTLE

R. DREARY
S. ETCHED
T. REACH
U. SPEEDBALL
V. NEXT
W. AWESOME
X. MIGHT
Y. ENDOW

A B C D E F G H I J K L M

N O P Q R S T U V W X Y Z

CREATE WHICH WORD? __

FIG. 8

```
5 REM  This version has a broad, short grid with broad instructions. for the citizen printer.
10 COLOR 7,1,1
50  DIM L$(5),LT%(26),WL$(35),WP$(35),LP$(26),WD$(35)
55 ERS$ = "                                                    "
58 KEY OFF
60 BL$ = "                          "
100  REM DOUBLE CROSTIC GENERATION PROGRAM
150 D$ =  CHR$ (4)
200  CLS
300  LOCATE 10,22,0 :PRINT "CRYPTO MESSAGE GENERATION PROGRAM"
320 LOCATE 12,26,0: PRINT "COPYRIGHT - KENNETH LUKER"
400  LOCATE 15,28: PRINT "PRESS RETURN TO BEGIN": LOCATE 17,30,0:PRINT "PRESS R TO
RESUME":GOSUB 3800
448 IF LC%>39 THEN DP$="COUNT"
450  IF A$ = "R" OR A$="r" THEN  RESUMING =-1:GOSUB 6000: INPUT "PRINT ONLY";B$:IF
LEFT$(B$,1)="Y" OR LEFT$(B$,1)="y" THEN GOSUB 7000:END
500  IF NOT RESUMING THEN  GOSUB 1000: IF F1 = 2 THEN  GOTO 500:'GET AND EXPLODE THE
QUOTATION
510 PRINT "AVERAGE LENGTH OF WORDS MUST BE";LEN(QS$)/NW%;"LETTERS."
520 GOSUB 3800
600  CLS: GOSUB 2000: IF F1 = 2 THEN  GOTO 500: REM BUILD THEWORDS
650  GOSUB 3700: GOSUB 9000:A$ = "": GOSUB 8300
700  GOSUB 3700:F1 = 0: GOSUB 8000: IF F1 = 0 THEN  GOTO 700: 'CREATE DEFINITION
710  ON F1 GOSUB 9000,5000
800  CLS: GOSUB 7000: GOSUB 950: REM PRINT THE DIAGRAM
900   END
950  INPUT "PRESS RETURN TO CONTINUE";B$: RETURN : REM  PAUSE
1000  REM  GET AND EXPLODE THE QUOTATION
1005 F1 = 0:WHILE F1 = 0: GOSUB 1200: WEND
1020 F1 = 0:NL% = 0
1030  WHILE F1 = 0 : GOSUB 1500: WEND
1040 F1 = 4: FOR I = 1 TO NL%:AL$ = L$(I): GOSUB 1600: QS$= QS$ +SS$ :NEXT I
1050 GOSUB 1700:F1 = 1: PRINT "QUOTATION EXPLODED" :GOSUB 1800:PRINT "Letters
Randomized":GOSUB 950
1060 RETURN
1200 REM GET AUTHOR AND TITLE
1210 CLS:LOCATE 4,1,1:LINE INPUT "ENTER THE AUTHOR AND TITLE:", A1$
1212 AL$ = A1$: IF LEN(AL$)>0 THEN GOSUB 1600:NW% =  LEN (SS$):LC$ = SS$
1220 IF NW% > 34 THEN  PRINT "AUTHOR-TITLE TOO LONG.": F1=2: ELSE IF LEN(SS$)=0 THEN GOTO
1210: ELSE F1 = 1
1230 RETURN
1500  REM INPUT THE QUOTATION LINES
1504  IF NL% = 5 THEN F1 = 1: RETURN
1506 NL% = NL% + 1: PRINT "TYPE LINE ";NL%: LINE INPUT L$(NL%)
1507  IF NL%=1 AND L$(NL%) = "PGP" THEN  GOSUB 1550
1510  IF  LEN (L$(NL%)) = 0 THEN F1 = 1:NL% = NL% - 1
1549  RETURN
1550  REM  PGP LETTERS DEFAULT
1560 L$(NL%) ="THESE WORDS DO NOT FORM A QUOTE BUT ARE SUPPLIED TO GIVE A CONSTANT
SET OF LETTERS FOR FORMING WORDS NCCYKLK IYJSEGIIE MPECKSA XIS PAWNSES
HEWSNICNIB LEYO HULEXDORAE SWERARIDDLENIMBL EEMPHAS IZEDOCKE UIAADDFAGG
IMNNR BLUDIRSSTTITT T
```

FIG. 13

```
1570 NL% = NL% + 1:L$(NL%) = ""
1599  RETURN
1600  REM PACK LETTERS
1602  SS$="": SL%= 0
1605  FOR J = 1 TO  LEN (AL$)
1610 CH$ =  LEFT$ (AL$,1):CV% =  ASC (CH$) - 64
1620  IF CV% > 0 AND CV% < 27 THEN SS$ = SS$ + CH$: IF F1 = 4 THEN SL% = SL% + 1
1625  IF (F1 = 4 AND SL% > 0 AND (CV% < 1 OR CV% > 26)) THEN SF$= SF$ +  CHR$ (SL% + 60):SL% = 0
1630  IF  LEN (SS$) > 254 THEN  PRINT "TOO MANY LETTERS":F1 = 2:J= 256
1640 AL$ =  MID$ (AL$,2)
1650  NEXT : IF F1 = 4 AND SL% > 0 THEN SF$ = SF$ +  CHR$ (SL% +60):SL% = 0
1660  RETURN
1700 REM CREATE LETTER POOL
1705  FOR I = 1 TO 26:LT%(I) = 0: NEXT
1710  FOR I = 1 TO  LEN (QS$):CV% =  ASC ( MID$ (QS$,I,1)) -64:LT%(CV%) = LT%(CV%) + 1
1720 LP$(CV%) = LP$(CV%) +  CHR$ (I):QP$ = QP$ +  CHR$ (35): NEXT
1730  RETURN
1800 REM randomize letters
1810 FOR I=1 TO 26:FOR J=1 TO
LT%(I):RD%=INT(RND*(LEN(LP$(I)))+1):LR$=LR$+MID$(LP$(I),RD%,1):LP$(I)=LEFT$(LP$(I),RD%-1)+R
IGHT$(LP$(I),LEN(LP$(I))-RD%):NEXT J:LP$(I)=LR$:LR$="":NEXT I
1820 RETURN
2000  REM BUILDING THE WORDS
2022  GOSUB 2450: REM DISPLAY WORD LABELS
2024  IF RESUMING THEN  GOSUB 2500 ELSE GOSUB 2460 'DISPLAY AUTHOR-TITLE COLUMN
2025 IF F1=2 THEN RETURN
2026  F3=1:GOSUB 2430: 'DISPLAY THE LETTER POOL
2030 A$="":WHILE F3=1:GOSUB 3000:WEND 'CREATE AND EDIT THE WORD LIST
2050  GOSUB 3700: PRINT "WORDS ARE BUILT": GOSUB 950
2060  RETURN
2430  REM DISPLAY POOL
2431 GOSUB 2700:IF DP$ = "FULL" THEN GOSUB 2600:RETURN
2432 LC%=0: FOR I = 1 TO 13: LOCATE I,68: PRINT  CHR$ (I + 64);LT%(I);:LC%=LC%+LT%(I):IF LT%(I) =
0 THEN  LOCATE ,69: PRINT "  ";
2433  IF LT%(I) < 10 AND LT%(I) > 0 THEN  LOCATE ,71: PRINT " ";
2435  LOCATE ,73: PRINT  CHR$ (I + 77);LT%(I + 13);:LC%=LC%+LT%(I+13): IF LT%(I +13) = 0 THEN
LOCATE ,74: PRINT "  "
2440  IF LT%(I + 13) < 10 AND LT%(I + 13) > 0 THEN  LOCATE ,76:PRINT " "
2445  NEXT : LOCATE 22:IF LC% < 40 THEN DP$="FULL":  RETURN
2450  REM SHOW COLUMN OF WORD LABELS
2451  LOCATE 1
2452  FOR I = 1 TO NW%: LOCATE ,1: IF I > 17 THEN  LOCATE (I -17),34
2453  IF I < 18 THEN  LOCATE I,,1
2454  IF I < 27 THEN  PRINT  CHR$ (I + 64);".";
2455  IF I > 26 THEN  PRINT  CHR$ (I + 22);".";
2456  NEXT:RETURN
2460 REM DISPLAY 1ST COLUMN, NOT RESUMING
2461 DW$="A" + LC$:GOSUB 4500:FOR I=1 TO NW%:LOCATE (-(I>17)*(I-17)-(I<=17)*I),3-(I>17)*33
2462 B$ =  MID$ (LC$,I,1): PRINT B$:WL$(I) = B$
2463 B =  ASC (B$) - 64:NN=B:GOSUB 4600:WP$(I) =  RIGHT$ (LP$(B),1): IF  LEN(LP$(B)) <  = 1 THEN
LP$(B) = ""
2464 IF LT%(B) < 0 THEN  CLS: PRINT "QUOTE DOESN'T HAVE AUTHOR-TITLE LETTERS":F1 = 2:
```

FIG. 14

```
GOSUB 950: RETURN
2465 IF LEN (LP$(B)) > 1 THEN LP$(B) = LEFT$ (LP$(B), LEN(LP$(B)) - 1)
2466 IF WP$(I) = CHR$ (1) THEN QP$ = CHR$ (I) + MID$ (QP$,2)
2468 IF WP$(I) < > CHR$ (1) THEN QP$ = LEFT$ (QP$, ASC(WP$(I)) - 1) + CHR$ (I) + MID$ (QP$, ASC
(WP$(I)) + 1)
2470 NEXT I :LOCATE 22
2480 RETURN
2500 REM DISPLAYS FIRST COLUMN FOR RESUMING
2505 FOR I=1 TO NW%:LOCATE (-(I>17)*(I-17)-(I<=17)*I),3-(I>17)*33
2510 PRINT LEFT$ (WL$(I) + BL$,30): NEXT :LOCATE 22: RETURN
2600 REM SHOW THE LETTERS INDIVIDUALLY
2610 LC%=0:I=1:L=1:J=1:WHILE J<27
2620 FOR K=1 TO ABS(LT%(J))
2625 IF LT%(J)<0 THEN COLOR 23 ELSE COLOR 7
2630 LOCATE I,L+67: PRINT CHR$(J+64):LC%=LC%+1
2640 L=L+1:IF L=11 THEN L=1:I=I+1
2650 NEXT K:J=J+1:WEND
2660 IF LC%>39 THEN DP$="COUNT"
2665 COLOR 7
2670 RETURN
2700 REM CLEAR THE LETTER DISPLAY AREA
2710 FOR I = 1 TO 13
2720 LOCATE I,68:PRINT "        ":NEXT
2730 RETURN
3000 REM EDIT WORD LIST
3005 GOSUB 3700:IF A$ = "" THEN INPUT "CREATE WHICH WORD";A$
3010 IF LEN (A$) = 0 THEN GOTO 3050
3015 WN = ASC ( LEFT$ (A$,1)) - 64: IF WN > - 16 AND WN < - 6 THEN WN = WN + 42
3017 IF WN < 1 OR WN > NW% THEN A$ = "": GOTO 3005
3018 LOCATE 23,,1: PRINT A$;": ";WL$(WN)
3020 DW$ = WL$(WN): GOSUB 3500 ' RETURN THE LETTER TO THE POOL
3021 LOCATE WN+17*(WN>17),4-33*(WN>17)
3022 PRINT LEFT$(BL$,29): LOCATE 22
3030 PRINT "TYPE NEW WORD ";A$;": ";: INPUT " ";AL$: IF LEN(AL$) < 2 THEN A$ = " ": GOSUB 4000
3040 IF LEN (AL$) > 1 THEN GOSUB 1600:A$ = SS$: GOSUB 4000
3050 GOSUB 3700: GOSUB 3100 'SEE IF READY TO SAVE
3060 IF A$="0" THEN GOSUB 5000:A$="":RETURN 'SAVE THE SESSION
3070 IF A$="*" THEN F3=2:RETURN 'FINISHED
3080 RETURN
3100 PRINT "PRESS '*' IF YOU ARE FINISHED, '0' TO SAVE 'TIL LATER": INPUT "OR CHOOSE THE
WORD YOU WANT TO CREATE";A$
3200 RETURN
3500 REM INCREMENT LETTER POOL
3502 IF LEN (DW$) < 2 THEN RETURN
3505 FOR I = 2 TO LEN (DW$):NN = ASC ( MID$ (DW$,I,1)) -64:LT%(NN) = LT%(NN) + 1:LL$ = MID$
(WP$(WN),I,1)
3510 IF LT%(NN) < 1 THEN GOSUB 3540 'FIX UNAVAILABLE POINTER AND QUOTE POSITION
3520 IF LT%(NN) > 0 THEN GOSUB 3580 'FIX QUOTE POSITION ONLY (NOT RETURNING AN
UNAVAILABLE LETTER)
3530 NEXT : GOSUB 2430:WP$(WN) = LEFT$ (WP$(WN),1): RETURN
3540 IF LL$ = CHR$ (255) THEN GOSUB 3600: RETURN 'REMOVE POINTER FROM LP$(NN)
3542 WW = ASC ( RIGHT$ (LP$(NN),1)) 'GET A WORD WHERE UNAVLBL LETTER WAS USED
```

FIG. 15

```
3545 FOR K = 2 TO LEN (WP$(WW)): IF MID$ (WP$(WW),K,1) = CHR$(255) AND MID$
(WL$(WW),K,1) = CHR$ (NN + 64) THEN KP = K:K=254
3550 NEXT:IF K<>255 THEN PRINT "ERROR, LINE 3550":STOP
3552 WP$(WW) = LEFT$ (WP$(WW),KP - 1) + LL$ + MID$ (WP$(WW),KP+ 1)
3554 IF LL$ < > CHR$ (1) THEN QP$ = LEFT$ (QP$, ASC (LL$) -1) + CHR$ (WW) + MID$ (QP$, ASC
(LL$) + 1)
3556 IF LL$ = CHR$ (1) THEN QP$ = CHR$ (WW) + MID$ (QP$,2)
3558 IF LT%(NN) = 0 THEN LP$(NN) = ""
3559 IF LT%(NN) < > 0 THEN LP$(NN) = LEFT$ (LP$(NN), LEN(LP$(NN)) - 1)
3560 RETURN
3580 LP$(NN) = LL$ + LP$(NN): IF LL$ = CHR$ (1) THEN QP$ = CHR$(35) + MID$ (QP$,2)
3590 IF LL$ < > CHR$ (1) THEN QP$ = LEFT$ (QP$, ASC (LL$) -1) + CHR$ (35) + MID$ (QP$, ASC
(LL$) + 1)
3595 RETURN
3600 REM DELETE REFERENCE IN LP$ TO THIS WORD
3610 FOR K=1 TO LEN(LP$(NN))
3620 IF MID$(LP$(NN),K,1) = CHR$(WN) THEN KP=K:K=254
3630 NEXT:IF K<>255 THEN PRINT "ERROR - LINE 3630": STOP
3640 IF KP<>1 THEN LP$(NN) = LEFT$(LP$(NN),KP-1) + MID$(LP$(NN),KP+1) ELSE
LP$(NN)=MID$(LP$(NN),2)
3650 RETURN
3700 REM CLEAR THE COMMUNICATION AREA
3710 LOCATE 22,1,0
3720 PRINT ERS$: PRINT ERS$: PRINT ERS$;
3725 LOCATE 22,1,1
3730 RETURN
3800 A$=INKEY$:IF A$="" THEN GOTO 3800
3810 RETURN
4000 REM PUT WORD IN LIST
4010 WL$(WN) = LEFT$ (WL$(WN),1) + MID$ (A$,2): IF WN > 17 THEN LOCATE (WN - 17),36
4020 IF WN < 18 THEN LOCATE WN,3
4030 PRINT LEFT$ (WL$(WN) + BL$,30):DW$ = WL$(WN): GOSUB 4500:GOSUB 2430: RETURN
4500 REM DECREMENT LETTER POOL
4502 IF LEN (DW$) < 2 THEN RETURN
4505 FOR I = 2 TO LEN (DW$):NN = ASC ( MID$ (DW$,I,1)) -64:LT%(NN) = LT%(NN) - 1
4510 IF F3 = 1 THEN GOSUB 4540: GOSUB 4580
4520 NEXT : RETURN
4540 REM LINK WORD AND QUOTE POSITION
4545 IF LT%(NN) < 0 THEN RETURN
4546 GOSUB 4600
4548 LL$ = MID$ (LP$(NN),LT%(NN) + 1,1):WP$(WN) = WP$(WN) + LL$:IF LL$ < > CHR$ (1) THEN QP$
= LEFT$ (QP$, ASC (LL$) -1)+CHR$(WN)+MID$(QP$,ASC(LL$)+1)
4550 IF LL$ = CHR$ (1) THEN QP$ = CHR$ (WN) + MID$ (QP$,2)
4552 IF LT%(NN) = 0 THEN LP$(NN) = ""
4555 IF LT%(NN) > 0 THEN LP$(NN) = LEFT$ (LP$(NN),LT%(NN))
4560 RETURN
4580 REM SAVE WORD OF UNAVAILABLE LETTER
4582 IF LT%(NN) > = 0 THEN RETURN
4584 LP$(NN) = LP$(NN) + CHR$ (WN):WP$(WN) = WP$(WN) + CHR$(255): RETURN
4600 REM PERMUTE THE UNUSED LETTERS
4610 IF LEN(LP$(NN))=1 THEN RETURN
4620 TS$=RIGHT$(LP$(NN),1)
```

FIG. 16

```
4630 LP$(NN)=TS$ + LEFT$(LP$(NN),LEN(LP$(NN))-1)
4640 RETURN
5000  REM SAVE SESSION
5005  GOSUB 3700:PRINT "FILENAME FOR SAVING: ";F$;: INPUT A$:IF A$="" THEN A$=F$ ELSE F$ =
A$ + ".DCF"
5010  OPEN F$ FOR OUTPUT AS #1
5030  PRINT#1, QS$: PRINT#1, A1$: PRINT#1, NW%: FOR I = 1 TO NW%:PRINT#1, WL$(I): NEXT
5040  FOR I = 1 TO 5: PRINT#1, L$(I): NEXT
5050  FOR I = 1 TO 26: PRINT#1, LT%(I): NEXT : PRINT#1,SF$
5052  FOR I = 1 TO NW%: FOR J = 1 TO  LEN (WP$(I)): PRINT#1, ASC( MID$ (WP$(I),J,1)): NEXT J: NEXT
I
5054  FOR I = 1 TO 26: PRINT#1,  LEN (LP$(I)): IF  LEN (LP$(I)) >0 THEN  FOR J = 1 TO  LEN (LP$(I)):
PRINT#1,  ASC ( MID$(LP$(I),J,1)):NEXT J
5055  NEXT I
5056  FOR I = 1 TO  LEN (QS$): PRINT#1,  ASC ( MID$ (QP$,I,1)):NEXT I
5058  FOR I = 1 TO NW%: PRINT#1, WD$(I): NEXT
5060  CLOSE  #1: PRINT "STATUS SAVED": RETURN
6000  REM RECOVER
6005  CLS:FILES "*.DCF": INPUT "FILENAME FOR RECOVERY:";F$:F$ = F$ + ".DCF"
6020  OPEN F$ FOR INPUT AS #1
6040  INPUT#1, QS$: INPUT#1, A1$: INPUT#1, NW%: FOR I = 1 TO NW%:INPUT#1, WL$(I): NEXT
6050  FOR I = 1 TO 5: LINE INPUT#1, L$(I): NEXT
6060  FOR I = 1 TO 26: INPUT#1, LT%(I): NEXT : INPUT#1, SF$
6062  FOR I = 1 TO NW%: FOR J = 1 TO  LEN (WL$(I)): INPUT#1,C:WP$(I) = WP$(I) +  CHR$ (C): NEXT J:
NEXT I
6064  FOR I = 1 TO 26: INPUT#1, B: IF B > 0 THEN  FOR J = 1 TO B:INPUT#1, C:LP$(I) = LP$(I) +  CHR$
(C): NEXT J
6065  NEXT I
6066  FOR I = 1 TO  LEN (QS$): INPUT#1, C:QP$ = QP$ +  CHR$ (C):NEXT I
6068  FOR I = 1 TO NW%: LINE INPUT#1, WD$(I): NEXT
6070  CLOSE #1
6077 AL$ = A1$: GOSUB 1600:NW% =  LEN (SS$):LC$ = SS$
6080  PRINT "STATUS RECOVERED": RETURN
6900  PRINT "NO RECOVERY FILE AVAILABLE": GOTO 400
6920 REM return YES or NO depending on rs$
6930 IF LEFT$(RS$,1)="Y" OR LEFT$(RS$,1)="y" THEN YES = -1:NO=0:RETURN
6940 YES = 0:NO = -1:RETURN
7000  REM PRINT THE DIAGRAM
7050   INPUT "DO YOU WANT TO SHOW THE SOLUTIONS TO THE CLUES?",A$: RS$= A$:GOSUB
6920:IF  YES THEN F1 = 3:ELSE F1 = 0
7055 WIDTH "LPT1:", 135
7060  INPUT "DO YOU WANT TO PRINT THE RESULTS ON A PRINTER?",A$:RS$= A$:GOSUB 6920:IF
YES THEN  OPEN "LPT1:" AS #1:J=7:ELSE OPEN "SCRN:" FOR OUTPUT AS #1
7070  IF J < > 7 THEN 7250
7071 print "Enter a title for the puzzle: ";:line input A$: PRINT#1, CHR$(27) "!!";:PRINT#1,
SPC(INT(48-LEN(A$))/2);A$
7075 PRINT#1, CHR$(27);"!";CHR$(20) CHR$(27)"k";CHR$(1) CHR$(27);"A";CHR$(6)
7077 PRINT#1,CHR$(27)"U1"
7080 A = 132
7084 PW%= INT(A/6):PRINT#1,CHR$(27) "Q" CHR$(A + 1)
7100 K = 1:L = 0:I = 1: FOR J = 1 TO  INT (( LEN (QS$) +  LEN(SF$)) /PW% + 1): GOSUB 7600: NEXT : FOR
M = 1 TO PW%:PRINT#1,CHR$(124);"-----";:NEXT:PRINT#1,CHR$(124)
```

FIG. 17

```
7105 PRINT#1,CHR$(27) "0"CHR$(18) CHR$(27) "M"
7200 PRINT#1,CHR$(27)"U0"
7250 IF F1=0 THEN GOSUB 7410 ELSE GOSUB 7430
7255 PRINT#1, CHR$(12) "CLUES:" CHR$(10)
7260  FOR I = 1 TO NW%: GOSUB 7500: NEXT
7300  PRINT
7360  INPUT "DISPLAY AUTHOR-TITLE-QUOTE?",A$:RS$=A$:GOSUB 6920:IF YES THEN  GOSUB 7450
7365 PRINT#1,CHR$(12)
7370 CLOSE #1
7400  RETURN
7410 PRINT#1,:PRINT#1,:PRINT#1,"Directions:"
7411 PRINT#1,"Each number in the clues stands for one letter in an answer word, and also corresponds "
7412 PRINT#1,"to one square in the grid.  As you answer the clues, transfer each letter to the same-"
7417 PRINT#1,"numbered square in the grid.  As a message grows in the grid, you can guess other words"
7418 PRINT#1,"in the message.  Transfer each guessed letter back to the clue indicated by its square."
7422 PRINT#1,"When you are done, the first letters of the answers will form a note about the message."
7424 RETURN
7430 PRINT#1,:PRINT#1,
7431 PRINT#1,"Answer key:  The answers and cell numbers are on the first two lines."
7432 PRINT#1,"          The clue is on the third line."
7434 RETURN
7450 REM DISPLAY AUTHOR, TITLE AND QUOTE
7460 PRINT #1,:PRINT#1,:PRINT#1, A1$
7470 FOR I = 1 TO 5: PRINT#1, L$(I): NEXT
7480 RETURN
7500 IF I = INT(NW%/2)+1 THEN PRINT#1, CHR$(12)
7510  PRINT#1,: PRINT#1, CHR$ (I -(I<27)* 64-(I>26)*22);".";: IF F1 = 3 THEN  PRINT#1, WL$(I);
7520 PRINT #1,:PRINT #1,SPC(2);
7550  PRINT#1, SPC( 2): FOR J = 1 TO  LEN (WL$(I)): PRINT#1,ASC (MID$ (WP$(I),J,1));: NEXT :
PRINT#1,:PRINT#1, SPC( 5)WD$(I):RETURN
7600 OK = K:OL = L:OI = I: FOR N = 1 TO 4: GOSUB 7700: NEXT :RETURN
7700 K = OK:I = OI:L = OL: FOR M = 1 TO PW%: PRINT#1, CHR$(124);: ON N GOSUB
7800,7900,7900,7900: NEXT : PRINT#1, CHR$(124): RETURN
7800  PRINT#1, "-----";: RETURN
7900  IF I < = LEN (SF$) THEN  IF L < > ASC ( MID$ (SF$,I,1))- 60 THEN  GOSUB 7950:L = L + 1:K = K +
1: RETURN
7920  PRINT#1, "#####";:L = 0:I = I + 1: RETURN
7950  IF N = 2 THEN  C1=ASC(MID$(QP$,K,1)):PRINT#1, RIGHT$(STR$(K),LEN(STR$(K))-1);SPC(-(K <
10) * 3 + (K > 9) * (K < 100)*2 -(K>99) ); CHR$ ( C1 - 64*(C1<27)-22*(C1>26));: RETURN
7955  IF N = 4 AND F1 = 3 THEN  PRINT#1, "  "; MID$ (QS$,K,1);"  ";: RETURN
7960  PRINT#1,  SPC( 5);: RETURN
8000 REM CREATE THE DEFINITIONS
8001 IF A$ = "" THEN  GOSUB 3700:INPUT "WHICH WORD DO YOU WANT TO DEFINE";A$: IF A$ = ""
THEN  INPUT "DO YOU WANT TO QUIT";B$: IF LEFT$(B$,1)="Y" OR LEFT$(B$,1)="y" THEN
F1=1:RETURN
8005  IF  LEN (A$) < > 1 THEN A$ = "": RETURN
8010 WN =  ASC ( LEFT$ (A$,1)) - 64: IF WN >  - 16 AND WN <  - 6 THEN WN = WN + 42
8020  IF WN < 1 OR WN > NW% THEN A$ = "": RETURN
8030  LOCATE 22:  PRINT A$;": ";WL$(WN);" "; WD$(WN); BL$
8040  LOCATE 23,1,1: LINE INPUT "ENTER '0' TO DELETE, OR NEW DEFINITION: ";A$: IF A$ = "" THEN
RETURN
8050  IF A$ = "0" THEN WD$(WN) = "": GOSUB 3700: GOSUB 8200:PRINT ".": RETURN
```

FIG. 18

```
8060 WD$(WN) = A$:  GOSUB 8200: PRINT "-": GOSUB 3700: GOSUB 3100
8080  IF A$ = "*" THEN F1 = 1: GOSUB 3700:PRINT "DEFINITIONS FINISHED"
8090  IF A$ = "0" THEN F1 = 2
8100  RETURN
8200  LOCATE -(WN < 18) * WN + -(WN > 17) * (WN - 17),-(WN<18)*2-(WN>17)*35: RETURN
8300  REM INDICATE PRE-DEFINED WORDS
8310  FOR WN = 1 TO NW%
8320  IF WD$(WN) <  > "" THEN  GOSUB 8200: PRINT "-"
8330  NEXT WN
8340  RETURN
9000  INPUT "DO YOU WANT TO SAVE THE STATUS NOW?",A$: IF  LEFT$(A$,1) = "Y" OR
LEFT$(A$,1)="y" THEN  GOSUB 5000: RETURN
9010  RETURN
9050 'WN = WORD NUMBER = POINTS TO THE WORD BEING EDITED
9060 'WL$(WN) = WORD SELECTED AS THE WNTH WORD IN THE WORD LIST
9070 'LT%(NN) = NUMBER OF COPIES OF LETTER NN AVAILABLE
9080 'LP$(NN) = A STRING FOR LETTER NN THAT CONTAINS CHARACTERS POINTING TO THE
POSITIONS IN THE QUOTE WHERE AN UNUSED LETTER NN IS FOUND.
9090 'LP$(NN) IS SHORTENED AS THE LETTER IS USED.  IT REACHES ZERO LENGTH, THEN
9100 'BEGINS TO GROW AGAIN AS THE LETTER IS USED MORE TIMES THAN IT WAS AVAILABLE
IN THE QUOTE.  THE CHARACTERS ADDED TO LP$(NN) NOW POINT TO THE WORD THAT USED
9110 'THE UNAVAILABLE LETTER.
9120 'QP$ HAS ONE CHARACTER FOR EACH LETTER IN THE QUOTE.
9130 'THE CHARACTERS POINT TO THE WORD WHERE THE LETTER IS FOUND.
9140 'IF NOT ASSIGNED TO A WORD, THE LETTER IS SHOWN AS BEING IN WORD 35.
9150 'THERE IS ONE WP$ STRING FOR EACH WORD IN THE WORD LIST. EACH CHARACTER
9160 'IS A POINTER TO THE POSITION IN THE QUOTE WHERE THE CORRESPONDING LETTER
9170 'FROM WL$ IS FOUND. THERE IS ONE WL$ FOR EVERY WORD IN THE LIST, AND IT
9180 'CONSISTS OF THE WORD ITSELF.
9190 'When a letter is used but none are available, that letter's LP$ is
9200 'modified by adding a character pointing to the word that used the
9210 'unavailable letter.  Then that word's WP$ has a character added (at
9220 'the letter's position in the word) pointing to position 255 of the quote.
9230 END
```

FIG. 19

```
5 REM This program accepts a named dcf file and supports its solving.
10 COLOR 7,1,1
50  DIM
L$(5),LT%(26),WL$(35),WP$(35),LP$(26),WD$(35),lmg%(255),lgm%(320),kv(48),lc%(26),wl%(35),lm$(26)
55 ERS$ = "                                                                    "
56 for i=1 to 48 :read kv(i):next'load up the keycodes for usable keys
57 data 9,65,66,67,68,69,70,71,72,73,74,75,76,77,78,79,80,81,82,83,84,85,86,87,88,89,90,32,8
58 data 72,75,80,77,71,79,15,73,81,59,60,61,62,63,64,65,66,67,68
59 KEY OFF
60 BL$ = "                                    "
70 def fn kv(a$)'gets the keycode for the pressed key
71     i=1:while i<29 and kv(i)<>asc(a$):i=i+1:wend
73     while i>28 and i<49 and kv(i)<>asc(right$(a$,1)):i=i+1:wend
74     if i<>49 then fnkv=i else fnkv=0
75 end def
80 def fn gp 'Use to set values when cursor is in grid
     shared gp%,mp%,lmg%(),wn%,co%,qp$,wr%,wc%,pc%,wb$(),gr%,gc%
     gr%=csrlin                    'Grid row
     gc%=pos                       'Grid column
     gp%=pos-(csrlin-2)*(csrlin>2)*80  'Grid position
     mp%=lgm%(gp%)                 'Message position
     wn%=asc(mid$(qp$,mp%,1))          'Word number
     co%=instr(wp$(wn%),chr$(mp%))     'Char offset in word
     wr%=wn%+6+mw%*(wn%>mw%)           'Word row
     wc%=2+co%-38*(wn%>mw%)            'Word column
     pc%=-(co%=1)*(40+wn%)             'Phrase column
     fn gp = 1
   end def
90 def fn wp 'use to set values when cursor is in words
     shared wn%,mw%,co%,mp%,gp%,gr%,gc%,wp$(),lmg%(),pc%,wr%,wc%
     wr%=csrlin                    'Word row
     wc%=pos                       'Word column
     wn%=csrlin-6-(pos>40)*mw%     'Word number
     co%=pos-2+(wn%>mw%)*38        'Char offset in word
     mp%=asc(mid$(wp$(wn%),co%,1))  'Message position
     gp%=lmg%(mp%)                 'Grid position
     gr%=int((gp%-1)/80)+2'grid row    'Grid row
     gc%=gp%-int((gp%-1)/80)*80        'Grid column
     pc%=-(co%=1)*(40+wn%)         'Phrase column
     fn wp = 1
   end def
   goto 96
95 print gr%;gc%;wn%:stop
96 rem on error goto 95
100  REM DOUBLE CROSTIC SOLVING PROGRAM
150 D$ =  CHR$ (4)
200  CLS
460 GOSUB 6000:PRINT "File Retrieved"'loads the file and the variables
462 IF NOT DONE THEN input "Clues are not all created. Try again";a$:if left$(a$,1)="y" or left$(a$,1)="Y" then
run else stop
464 CLS:LOCATE 1,23,0 :PRINT "DOUBLE CROSTIC SOLVING PROGRAM"
470 CLOSE #1:gosub 500 'post the answer grid
```

FIG. 20

```
472 gosub 600 'post the word structure
473 gosub 620 'post the phrase structure
474 locate 7,3,1,4,7:tp%=fnwp ' tab position: 1=words, 2=message, 3=phrase area
490 b%=1: md%=1:gosub 700 'change cursor character and message character to bold.
496 goto 1000 'Go to main waiting place
500 Rem Post the answer grid
501 locate 2,1,1:mp%=0:for j=1 to len(sf$) ' set message position at 0. sf$=string whose length equals the number
of words, and hence also of blanks, in the message.
503 for L=1 to asc(mid$(sf$,j,1))-60: print "-"; ' print dashes for each character & incr grid pos and msg pos
504 mp%=mp%+1:gp%=gp%+1:lmg%(mp%)=gp%:lgm%(gp%)=mp%:next L ' and point word and msg chars at
each other,
505 print " ";:gp%=gp%+1:next J ' then insert space and incr grid pos only
506 return
600 Rem Post the word structure
601 mw%=int((nw%+1)/2):for i=1 to nw%:locate (-(i>mw%)*(i-mw%+6)-(i<=mw%)*(i+6)),1-(i>mw%)*38
'mw%=number of middle word
602 for j=1 to len(wp$(i)):print "-";  ' put a hyphen in each letter pos
   next:next:locate 24,1:return 'for each char in word, print hyphen
620 Rem post the phrase structure
621 for i=1 to nw%:locate 6,40+i:print "-";:next:return
700 REM Bold or unbold the characters, & return to same position
   if b%=1 then color 12 else color 7    'set the bolding direction
   on tp% gosub 750,760,750:on md% gosub 4200,4250   'bold the current position
   on tp% gosub 760,750,760:on md% gosub 4200,4250   'bold to the other sector
   if pc%>0 then gosub 770 :on md% gosub 4200,4250   'bold phrase position if needed
   on tp% gosub 750,760,770            'Return to original position
   return
750 locate wr%,wc%:return              'move to word sector
760 locate gr%,gc%:return              'move to grid sector
770 locate 6,pc%:return                'move to phrase sector
780 a=fn wp:return                     'recalibrate word position
790 a=fn gp:return                     'recalibrate grid position
800 rem move left while in words
   if co%=1 then gosub 810 else wc%=wc%-1'can't move left
   locate wr%,wc%:a=fnwp
   return
805 wc%=-3*(wn%<=mw%)-41*(wn%>mw%)'move to leftmost position
810 rem in leftmost position already
   if wn%=1 then wc%=41:wr%=7+int(nw%/2)' in leftmost position already
   if wn%=mw%+1 then wc%=3:wr%=7+mw%
   wr%=wr%-1:return
820 rem move left while in grid
   if gc%=1 then gosub 825 else gp%=lmg%(lgm%(gp%)-1)
   gc%=gp%-int((gp%-1)/80)*80:gr%=int((gp%-1)/80)+2
   locate gr%,gc%:a=fngp
   return
823 if gr%>2 then
gc%=gp%+80*(lgm%(gp%-80)>0)+79*(lgm%(gp%-80)=0):gc%=gc%-int((gc%-1)/80)*80:gr%=gr%-1:return
   cl%=int((lmg%(len(qp$))-1)/80):gp%=gp%+cl%*80:gp%=gp%+(lgm%(gp%)=0)
   gc%=lmg%(len(qp$))-cl%*80:gr%=2+cl%:return'gp%-cl%*80):return
825 rem at first column already
   if gr%=2 then gp%=lmg%(len(qp$)) else gp%=lmg%(lgm%(gp%)-1)
```

FIG. 21

```
  gr%=gr%-1:return
830
840 return'move while in phrase
860 'move right while in words
  if co%=len(wp$(wn%)) then gosub 865 else wc%=wc%+1 ' can't move right
  locate wr%,wc%:a=fnwp:return
865 if wn%=nw% then wc%=3:wr%=7:return
  if wn%=mw% then wc%=41:wr%=7:return
  wr%=wr%+1:wc%=3-(wn%>mw%)*38
  return
870 rem move right while in grid
  if mp%=len(qp$) then gosub 875 else gp%=lmg%(lgm%(gp%)+1)
  gc%=gp%-int((gp%-1)/80)*80:gr%=int((gp%-1)/80)+2
  locate gr%,gc%:a=fngp
  return
875 rem at last column already
  if mp%=len(qp$) then gp%=1:return
878 return 'move down while in grid
890 return'move while in phrase
999  Rem Wait for and act on a keystroke
1000  if tp%=1 OR TP%=2 then gosub 4275  ' display the current clue
1001  a$=inkey$:if a$=""then goto 1001
1002  gosub 1100 ' get value of key to determine action
1003  goto 1000 'record cursor position and wait for another key
1099  stop
1100 kv%=fnkv(a$):Rem get value of key to determine action
1101 if kv%=1 then gosub 1200:return          'Tab, jump to other area
1102 if kv%>38 then gosub 2100:return         'Function key
1103 if kv%>1 and kv%<28 then gosub 1300:return 'Letter, put in the letter
1104 if kv%=0 then gosub 4275:return ' Make sure Caps Lock is on
1105 on kv%-27 gosub 1350,1380,1400,1400,1400,1400,1500,1600,1700,1800,1800:return
1106 Rem: above represent space,bkspc,arrow,home,end,shftab,pageup,pagedown,
1200 on tp% gosub 760,750,770          'Tab:jump then change tab pointer
1201 tp%=tp%+1
  if tp%=3 then tp%=1
  if tp%=4 then tp%=3'
1202 return                    'No jump from phrase sector
1300 Rem Letter:put in place & move to right
1301 b%=0:md%=2:gosub 700:kv%=33:gosub 1400: return '
1350 A$="-":gosub 1300 :return 'space key:put - in place, move to right
1380 kv%=31:gosub 1400:GOSUB 1350:kv%=31:GOSUB 1400 :return 'backspace:move to left, replace with -
1400 Rem arrow key:move in arrow direction within sector
1401 b%=0:md%=1:gosub 700'dim the characters
1402 on kv%-29 gosub 1405,1410,1415,1420:return' Up, left, down or right
1405 Rem UP arrow:
  on tp% gosub 805,823':print gp%;gr%;gc%;tp%;:stop'up arrow: move up one row
  on tp% gosub 750,760' :print gp%;gr%;gc%;:stop
  on tp% gosub 780,790':print gp%;gr%;gc%;:stop
  b%=1:md%=1:gosub 700:return
1410 Rem Left Arrow
1411 on tp% gosub 800,820,840
1412 b%=1:md%=1:gosub 700:return
```

FIG. 22

```
1415 REM down arrow
   on tp% gosub 865,878,890
   on tp% gosub 750,760
   on tp% gosub 780,790
   b%=1:md%=1:gosub 700:return
1420 Rem right arrow
1421 on tp% gosub 860,870,890
1422 b%=1:md%=1:gosub 700:return'right arrow
1440 return'go to new line
1500 return'home key:
1600 return'end key
1700 return'shift tab:move to phrase area
1800 return'page up or down
2100 return'function keys
3000 return 'locate message char and move there
4000 return 'locate word char and move there
4200 print chr$(screen(csrlin,pos));:locate csrlin,-(pos-1)*(pos<>1)-(pos=1):return ' bold or unbold the existing
character
4250 print a$;:locate csrlin,-(pos-1)*(pos<>1)-(pos=1):return 'Print the typed letter
4275 r%=csrlin:c%=pos:locate 25,1:print ERS$;:locate 25,3:if kv%=0 then print "Make sure CAPS LOCK is on,
then press a letter or a movement key.";:locate r%,c%:return
4276 print wd$(wn%);:locate r%,c%:return ' print the clue
4300 return 'move to left
4400 return 'move to right
4500 return 'move up
4600 return 'move down
6000  REM RECOVER
6001  FILES "D:\GAMES\DUB\*.dcf"
6005  LOCATE 1,1,0:INPUT "FILENAME FOR SOLVING:";F$:F$ ="d:\games\dub\"+F$ + ".DCF"
6010  rem ON ERROR GOTO 6900
6020 OPEN F$ FOR INPUT AS #1
6040  INPUT#1, nw%: INPUT#1, sf$:INPUT#1,lqp%
6050  for i=1 to lqp%:input#1, c:qp$=qp$+chr$(c):next
6060  FOR I = 1 TO 26: INPUT#1, LT%(I):input#1,lc%(i): NEXT
6062  FOR I = 1 TO 26: if lt%(i)<>0 then for j=1 to abs(lt%(i)):input#1,c:lp$(i)=lp$(i)+chr$(c):next j
6063  next i
6064  FOR I = 1 TO 26: if lc%(i)<>0 then for j=1 to lc%(i):INPUT#1,c: lm$(i)=lm$(i)+chr$(c):next j
6065  next i
6066  FOR I = 1 TO NW%:input#1,wl%(i):next
    for i=1 to nw%:for j=1 to wl%(i):input#1,c:wp$(i)=wp$(i)+chr$(c):next j:next i
6067 for i=1 to nw%: LINE INPUT#1, WD$(I):NEXT
6068 DONE = -1:FOR I=1 TO NW%:IF LEN(WD$(I))<1 THEN DONE=0
6069  NEXT
6070  CLOSE #1
6080  PRINT  "STATUS RECOVERED FOR FILE: "F$: RETURN
6900  print len(qp$):stop 'PRINT "NO RECOVERY FILE AVAILABLE":RETURN
7450 REM DISPLAY AUTHOR, TITLE AND QUOTE
7460 PRINT #1,:PRINT#1,:PRINT#1, A1$
7470 FOR I = 1 TO 5: PRINT#1, L$(I): NEXT
```

FIG. 23

```
7480 RETURN
    rem nw%=number of words, wn%=word number being considered
    rem mw%=number of words in first column; half of nw%
    rem lgm(x) = link of character at x in grid to message position
    rem lmg(y) = link of character at y in message to grid position
    rem tp% = 1 for words, 2 for grid, 3 for phrase :tab position
    rem wd$(wn%)=clue for word wn%
    rem if tp%=1, then gp%=pos-(csrlin-2)*(csrlin>2)*80
    rem mp%=lgm%(gp%):wn%=asc(mid$(qp$,mp%,1)):co%=instr(wb$(wn%),chr$(mp%))
    rem word location = locate wn%+8+mw%*(wn%>mw%),2+co%-38*(wn%>mw%)
    rem if tp%=2, then wn%=(csrlin-8)-(pos>40)*40
    rem co%=(pos-2)+(wn%>mw%)*38:mp%=asc(mid$(wp$(wn%),co%,1))
    rem gp%=lmg%(mp%)
    rem grid location = locate int(gp%/80)+2,gp%-int((gp%-1)/80)*80
```

FIG. 24

DOUBLE CROSTIC TECHNIQUES

This is a Utility Patent Application claiming priority from Provisional Patent Application No. 60/119,831 which was filed on Feb. 12, 1999.

A listing of one preferred embodiment of the computer code is submitted herewith as FIGS. 13–24.

A portion of the disclosure of this application contains material subject to copyright protection. The copyright owner has no objection to facsimile reproduction by anyone of the patent document or patent disclosure as it appears in the Patent and Trademark Office patent files or records, but otherwise reserves all copyrights in and to the material of this disclosure.

BACKGROUND OF THE INVENTION

1. Field of the Invention

The invention generally relates to computer programs involving double crostic techniques. More specifically, the invention relates to a computer program for creating, storing, printing, organizing, solving, and publishing double crostic puzzles.

2. State of the Art

Word games and vocabulary puzzles are popular forms of entertainment. Perhaps the best known of such games is the crossword puzzle. Crossword puzzles can be found in daily newspapers, weekly magazines, monthly periodicals, and in puzzle books dedicated solely to the task of solving crossword puzzles. Over the past decade a number of computer programs capable of aiding in the creation of crossword puzzles have been written. Such programs allow the user of the program to create word sets, clues sets, and solution sets to facilitate the creation of a computer generated crossword puzzle. A representative example of such a program is described in U.S. Pat. No. 5,667,438 issued to Peter H. Rehm.

Similar in some respects to crossword puzzles, double crostic puzzles are becoming more popular as word games. Double crostic puzzles are also sometimes called acrostic puzzles, but for the purposes of this disclosure the term double crostic puzzle will be used to consistently refer to both double crostic puzzles and acrostic puzzles. An example of an unsolved hard copy double crostic puzzle is illustrated in FIG. 1. The corresponding solution set to the double crostic puzzle illustrated in FIG. 1 is illustrated in FIG. 2.

A typical double crostic puzzle involves two encrypted messages. Often times, the encrypted messages are related. For example, the first encrypted message may be the name of a person and the second encrypted message may be a quote from the person identified by the first encrypted message. A solution to the double crostic puzzle in the example would reveal the quotation and the name of the individual who coined the quotation. A solution is achieved by deciphering a set of solution words. Each letter of the solution words corresponds with a letter in the encrypted messages. As the solution words are deciphered, the encrypted messages are revealed. Much like a crossword puzzle, each solution word has a corresponding clue which enables deciphering of the solution word. For example, the clue "Roses are red, Violets are__" would prompt the solution word "blue."

One of the unique features of a double crostic puzzle is that the set of solution words is partially determined from the first encrypted message. Each letter of the first encrypted message corresponds to the first letter in exactly one solution word. As the solution words are deciphered, a solution to the first encrypted message is produced. Likewise, the letters of the solution words correspond to exactly one letter in the second encrypted message such that, as the solution words are deciphered, a solution to the second encrypted message is revealed. Therefore, the letter "b" of the solution word "blue" in the example above would correspond to one letter in the first encrypted message, and each of the letters "b" "l" "u" and "e" would correspond to letters in the second encrypted message.

To best illustrate the workings of a double crostic puzzle, a double crostic puzzle in both an unsolved and solved state is examined. An example of an unsolved double crostic puzzle is illustrated in FIG. 1. Two encrypted messages are displayed: a first encrypted message 500 and a second encrypted message 510. A set of undeciphered solution words 520 and their corresponding clues 530 are also depicted. The position of the letters making up the encrypted messages 500 and 510 are represented by letter lines wherein in each letter line represents one letter in the solution of the encrypted message. Beneath each letter line is an index number and a solution word identifier.

The numbers beneath the letter lines in the second encrypted message 510 are consecutively numbered beginning with the number "1" and ending with the number "141." The consecutive numbering scheme provides an index number for each letter. As illustrated, each undeciphered solution word in the set of solution words 520 is also represented by a letter line and an index number. The index numbers appearing below the letter lines of the set of solution words 520 correspond with the index numbers of the second encrypted message 510. Each of the index numbers in the second encrypted message 510 appears only once within the letter lines of the set of solution words 520. The solution of the double crostic puzzle may therefore be produced by deciphering the solution words. As the solution words are deciphered, the letter lines of the solution words may be filled in and the letter corresponding to the index number of a letter line in the solution word may be transcribed into the second encrypted message 510 on the letter line having the corresponding index number. As additional solution words are deciphered, a greater portion of the second encrypted message 510 is revealed. In addition, the first encrypted message 500 is represented by a set of letter lines having index numbers corresponding to the first letter line in each of the solution words in the set of solution words 520. As the solution words are deciphered, the letter appearing in the first letter line position of the solution word may be transcribed onto the letter line of the first encrypted message 500 corresponding to the index number of the solution word letter line. The index numbers thereby provide a means with which to associate the letters contained in the set of solution words 520 with the letter lines of the encrypted messages 500 and 510 so that, as the solution words are deciphered, the encrypted messages 500 and 510 are revealed.

It is also possible to work backwards by solving portions of one of the encrypted messages and transcribing the letters in the solved letter lines onto the corresponding letter lines in the set of solution words 520 such that the solution words may be deciphered. In addition to index number identification, each of the letter lines of the encrypted messages 500 and 510 are identified by solution word identifiers to provide a cross reference to the set of solution words 520. The solution word identifiers in FIG. 1 are the letters "A" through "Y" which appear next to the index numbers. Each solution word in the set of solution words

520 is represented by a solution word identifier. The letter lines in the solution word correspond to the solution word identifier. For example, the solution word identifier "I" corresponds to the solution word clue "Walk noiselessly or carefully." Each letter line in the solution word therefore corresponds to the solution word identifier "I." This identification allows an individual attempting to solve the double crostic puzzle to view the encrypted messages 500 and 510 and associate all of the letter lines identified by the solution word identifier "I" with the solution word represented by the solution word identifier "I." If a letter line in one of the encrypted messages 500 and 510 is solved without the aid of the solution word and corresponding index number, the solution word identifier in the encrypted message provides a simple cross-reference to the solution word by using the solved letter lines of the encrypted message to decipher the corresponding solution words.

FIG. 2 further clarifies the concept behind a double crostic puzzle. The solution to the unsolved double crostic puzzle of FIG. 1 is depicted in FIG. 2. The solution word corresponding to the solution word clue "Walk noiselessly or carefully" is "TIPTOE." The letters making up the solution word "TIPTOE" are each associated with an index number. The first letter "T" is associated with index number "75"; the second letter "I" is associated with the index number "54"; and so on. Each letter associated with the solution word also appears in the encrypted messages 500 and 510 at the appropriate letter line identified by the corresponding index number of the letter line. Likewise, the letter line represented by index number "117" in the second encrypted message is "A." The corresponding solution word identifier for that letter line is the letter "R." Therefore, it is known that the letter "A" represented by index number "117" belongs in the solution word identified by the solution word identifier "R" and solution word clue "All the world is sad and_ . . . " The fourth letter line in the solution word corresponding to the solution word identifier "R" has the index number "117" so it is known that the fourth letter line in the solution word is "A." As the solution words are determined, or as portions of the encrypted messages 500 and 510 are solved, the solution to the double crostic puzzle is revealed.

Typically, a double crostic puzzle as depicted in FIG. 1 is solved by hand. For example, a solution word is deciphered and each of the letters in the solution word are transcribed into positions in the encrypted messages corresponding to the index numbers of the letter lines of the solution words. Likewise, letters from letter lines in the encrypted messages which are obvious may be transcribed to the letter lines in the set of solution words corresponding to the solution word identifiers and index numbers, thereby providing a method with which to decipher solution words. This process can be long and tedious, and frequently, a number of errors occur during the solution process which require the changing of letters and rearrangement of corresponding letters in the solution sets. Therefore, it is desirous to automate the solution process of double crostic puzzles.

Just as computer programs which facilitate the creation and solving of crossword puzzles exist, so do computer programs for the creation and solving of double crostic puzzles and acrostic puzzles. The automation processes provided by computer programs provide an environment in which double crostic puzzles may be solved without the tedium of solving double crostic puzzles by hand. Double crostic puzzle computer programs also provide a means with which to distribute puzzles to a large populace through electronic file transfer. A creator of a double crostic puzzle may encode the puzzle in electronic format and share the puzzle with an individual living in another country by means of electronic file transfer over the internet or modem. In addition files may be saved to media such as floppy disks, compact discs, dvd disks, hard drives and the like.

One example of a computer program which may be used to solve double crostic puzzles is the E-Crostic© computer program by QuuxWare, copyrighted in 1998 by David Howorth. The E-Crostic© program is available as download over the internet and provides a visual environment in which a user may solve a double crostic puzzle which has been created and saved in the E-Crostic© format. The visual environment provided by the E-Crostic© program is similar to that described above with reference to FIGS. 1 and 2, the only difference being that the E-Crostic© program provides boxes instead of letter lines for the second encrypted message. The E-Crostic© program automates the process of solving the double crostic puzzles. A user may enter letters in the letter lines of the solution words or in the boxes (letter lines) of the encrypted messages. As the user inputs a letter in a letter line defined by the index number, the E-Crostic© program automatically places a copy of the letter in the letter line corresponding to the index number. For example, if the letter "Z" is input into a solution word letter line having an index number of "54" the letter "Z" is copied to the letter line or lines in the encrypted messages having the same index number "54." The process of filling in the letter lines is thereby automated. The automation process allows the simultaneous transcription of letters between the letter lines of the solution words and encrypted messages so that the user need not spend the time transcribing the answers. In addition, the automation process allows the user to rapidly correct mistakes in solution words or an encrypted message without the tedium associated with solving double crostic puzzles by hand. The E-Crostic© program also provides the user with the option of printing the double crostic puzzle in hard copy format so that the double crostic puzzle may be solved by hand.

Another computer program allows the user to both create and solve double crostic puzzles. The ENIGMACROSS™© for Windows computer program copyrighted in 1997 by Sam Bellatto Jr. allows a user to open double crostic puzzles saved in the ENIGMACROSS™© format and solve them in much the same way as the E-Crostic© program. The ENIGMACROSS™© program also allows the user to create and save a double crostic puzzle in electronic format. A completed puzzle may also be printed in hard copy format for manual solving.

The creation of a double crostic puzzle using the ENIGMACROSS™© program entails opening a new file for input by the program of the data obtained by the user which is used to create the double crostic puzzle. The ENIGMACROSS™© program first prompts the user to enter a message which is to be encrypted. This is similar to the second encrypted message described with reference to FIGS. 1 and 2. Next, the user is prompted for the author of the message, or what is to become the first encrypted message of FIGS. 1 and 2. The ENIGMACROSS™© program then creates a set of letter lines for the solution words from the letters of the author message. The user is then allowed to create a set of solution words using the set of letters from the first message entered by the user. ENIGMACROSS™© visually displays the message from which the letters for the set of solution words may be chosen. As each letter of the solution words is placed, the letter disappears from the message and is no longer available to create solution words. As the user creates the solution words, ENIGMACROSS™© also provides a letter bank which displays how many of each letter remain for use in the set of solution words. The ENIGMACROSS™© program, however, does not allow the user to use letters which are not available in the message list, or use more letters than are available in the message list. After the set of solution words is created, the user is prompted to enter the clues for the solution words. The double crostic puzzle is then complete, and it may be saved in electronic format so others may attempt to solve the puzzle.

Although the computer programs which provide automated creation and solving of double crostic puzzles are available, it would be advantageous to provide additional features and automation components in a double crostic computer program to enhance the creation and solving of double crostic puzzles.

BRIEF SUMMARY OF THE INVENTION

The present invention generally involves a computer program for creating, printing, storing, organizing, solving and publicizing double crostic puzzles and playing a solitaire game based upon the double crostic puzzle theme. The computer program allows a user to create or solve double crostic puzzles with minimal effort because the computer program accomplishes the "book keeping" and layout requirements of a double crostic puzzle. In addition, the computer program may be used as a solitaire game wherein the user attempts to create a puzzle from a preselected letter bank.

Generally, the computer program prompts a user to select one of at least three options: create a double crostic puzzle, solve a double crostic puzzle, or play the double crostic solitaire game. Depending upon the users selection, a series of programming steps are executed.

The creation of a double crostic puzzle requires a user to input two messages. The first message being an identifier of the second message and the second message being a quotation or the like. From the letters of the first message, the computer organizes a list from which a set of solution words may be created. The computer analyzes the second message entered by the user and develops a letter bank corresponding to the letters of the message. Each letter in the letter bank is assigned a reference pointer corresponding to its position within the message. The user is prompted to create solution words from the letters available to the user as reflected in the letter bank. As individual solution words are created, the computer keeps track of the number of letters remaining in the letter bank and displays the information to the user. If at any time the user uses letters to create solution words which are no longer available from the letter bank, the displayed letter bank indicates a negative value but allows the user to continue to form solution words. A proper set of solution words results when all of the letters of the letter bank have been used exactly once in the creation of the set of solution words. The user is then prompted to input clues for each solution word. The creation of the double crostic puzzle is complete after a valid set of solution words is created for the messages and all of the clues for the solution words have been inputted. The puzzle may then be saved to some form of computer storage media or transferred via the internet.

The computer program is capable of reading or loading double crostic puzzles stored in the format recognized by the computer program. The computer program prompts the user for the name or location of the file containing the data of the double crostic puzzle. The data is loaded into the memory of the computer or made accessible to the computer program. An output device associated with computer, such as a monitor, is prompted to display letter lines for each of the two messages and a set of solution words. The clues used to decipher the solution words are also displayed. Solution of the double crostic puzzle is accomplished by entry of letters into the letter lines of the messages and the solution words. As a letter is entered into the letter line of a solution word, the same letter is transcribed by the computer program into the corresponding line within the messages. Likewise, if a letter is entered in a letter line of one of the messages, the same letter is transcribed into the letter line associated with one of the solution word corresponding to the letter line of the message. A solution, or partial solution, may be saved at any time such that the user may later return to the puzzle and complete the solution process. In addition, a hard copy of the double crostic puzzle may be printed so that a hand solution may be generated.

The double crostic solitaire game allows users to play a game and improve their double crostic puzzle creation skills. The double crostic solitaire game prompts the user for a message from which a set of solution words is established. Each letter of the message entered is transcribed as a first letter to a solution word in the set of solution words. A letter bank is provided to the user from which solution words may be created. The letter bank may be a pre-specified word group or a word group chosen by the user. Based upon the available letters in the letter bank, the user must create a set of solution words which only use the letters from the letter bank. Thus, the double crostic solitaire game is very similar to the creation of a double crostic puzzle, with the exception that the letter bank is a predefined finite set of letters rather than being dependent on the letters in a second message.

BRIEF DESCRIPTION OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

FIG. 1 is an illustration of a double crostic puzzle in an unsolved state;

FIG. 2 is an illustration of the double crostic puzzle of FIG. 1 in a solved state;

FIGS. 4*a–c* are printouts of the double crostic puzzle of FIG. 1 recreated with the present invention;

FIGS. 5*a*–5*c* are printouts of the solution of the double crostic puzzle of FIGS. 4*a*–4*c;*

FIG. 7 illustrates a partially created double crostic puzzle using the present invention;

FIG. 8 illustrates a properly created double crostic puzzle;

FIGS. 13–24 are BASIC program listing of one preferred embodiment of the present invention.

DESCRIPTION OF THE ILLUSTRATED EMBODIMENTS

The present invention generally involves a computer program for creating and solving double crostic puzzles, as well as a game for improving double crostic puzzle creation skills. A computer having a memory, an input device, and at least one output device is capable of running the computer program. With the advent of passive menu systems in computer programs, it is foreseeable, and considered to be within the scope of this disclosure, that the choice to create new puzzles, resume work on old puzzles, load files, print results or hard copies, and other standard program functions, may be activated by the user through a menu, at any time during use of the program. Although the BASIC computer program listing of one preferred embodiment of the computer program of the present invention is listed in FIGS. 13–24, it is understood that the present invention also includes conversions of the program logic to other programming languages, as anyone having standard knowledge in the computer programing arts could easily convert the program of the present invention to another computer language.

The computer program of the present invention involves three main components: a double crostic puzzle creator, a double crostic puzzle solver, and a double crostic solitaire game. It is understood that, at any point in the operation of the computer program of the present invention, a user may save their work to an electronic file which can be loaded into the computer by the program at a later date. It is also understood that at any time, users may choose to exit the computer program of the present invention, at which time users may be prompted as to whether or not they wish to save their work before terminating the operation of the program.

The Double Crostic Puzzle Creator

A user wishing to create a double crostic puzzle accesses the double crostic puzzle creation component of the present invention. The user provides the information necessary to create a double crostic puzzle and the computer program facilitates the creation by organizing, displaying and recording the users input.

Figure 3:
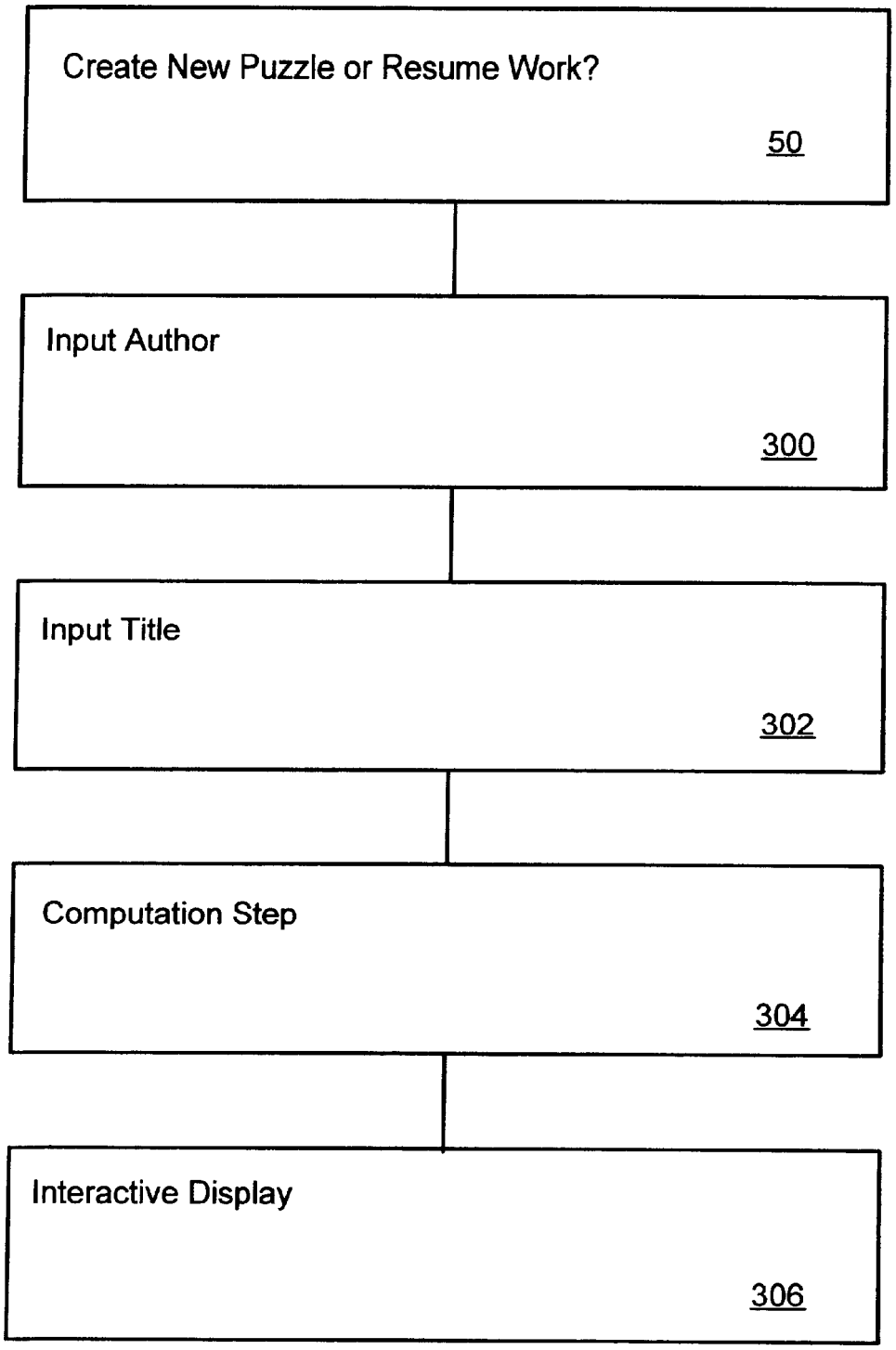
FIG. 3 is a flow diagram of the steps executed by the computer program of the present invention during the creation process of a double crostic puzzle.

FIG. 3 illustrates a general flow diagram of the steps which occur during the creation of a double crostic puzzle using the present invention. First the user is prompted to indicate whether they wish to create a new puzzle or resume work on a saved puzzle 50. If the user chooses to resume work on an old puzzle, the puzzle is loaded into the program and the user may begin where they had previously left off For this example, assume that the user chooses to create a new puzzle. The program prompts the user to input the author 300 into the computer running the program. The entry by the user is saved in the memory of the computer, or written to an electronic file, as the first message 600. The program then prompts the user to input the title 302. The user's entry is saved in the computer memory or written to an electronic file as the second message 610. A computation step 304 occurs in which the program executes a series of calculations which facilitate the creation of the double crostic puzzle.

During the computation step 304, the letters of the first message 600 and second message 610 are compared. A valid double crostic puzzle may only be created if all of the letters of the first message 600 are a subset of the second message 610.This requirement is verified by the program. If the subset requirement is not met, the user may be notified with an error message and rerouted to the author entry step 300 to begin the creation process anew. If the subset requirement is satisfied, the computation step 304 continues. Each letter in the second message 610 is then assigned an index number in accordance with its position within the message. The letters of the first message 600 and second message 610 are extracted into separate bins, each bin representing a different letter of the alphabet. The program determines the number of letters in each bin and randomly sequences the numbers in the bins for extraction into solution words. The number of required solution words is determined from the number of letters in the first message 600. Because each letter of the first message 600 represents the first letter of a solution word, the number of letters in the first message 600 is the same as the number of solutions words. The number of letters available in the letter bank is then divided by the number of solution words required to produce a solution to the double crostic puzzle. The resulting value represents the required average length for each solution word needed to use all of the letters from the letter bank. For example, if there are 25 letters in the first message 600 and 141 letters in the second message 610, the required average length for each solution word would be 5.64 letters. The computation step 304 then creates the first letters in the set of solution words and assigns a solution word identifier to each letter.

Figure 6:
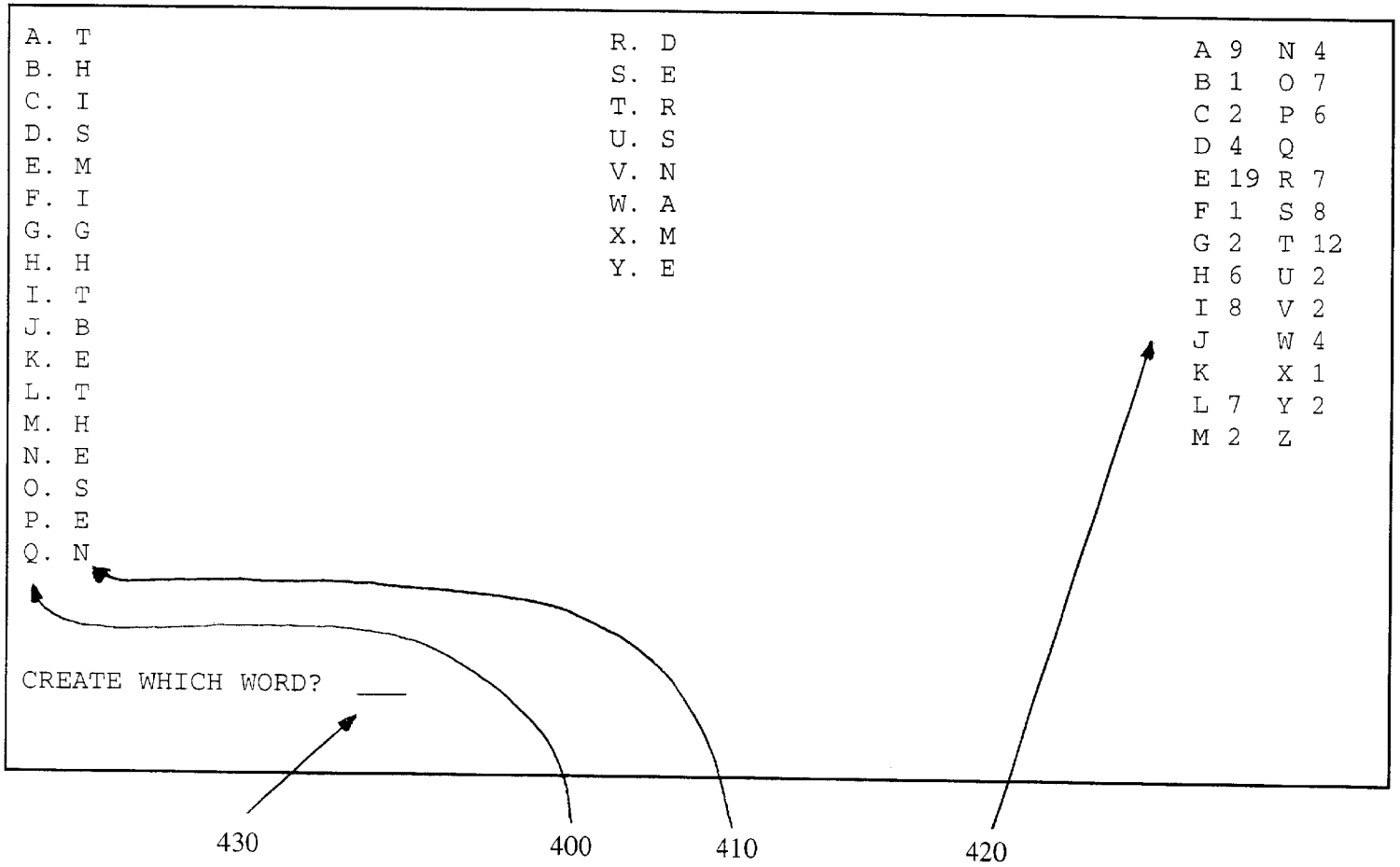
FIG. 6 illustrates the double crostic puzzle creation program.

Once the computation step 304 is complete, the program creates an interactive user display on the output device of the computer 306. FIG. 6 illustrates an example of the interactive user display. The display consists of the solution word identifiers 400 followed by the first letter of the solution word identified by the identifier 410. The letter bank 420 is also displayed, wherein all of the letters of the alphabet are displayed along with the number of letters contained in the letter bank. Alternatively, the actual letters contained in the letter bank may be displayed. Initially, the letter bank contains the same number of letters as in the second message 610 minus the number of letters used to create the first letters of the solution words. Referencing FIGS. 5*a*–5*c*, the second message 610 consists of 141 letters and the first message 600 consists of 25 letters. Thus, the letter bank would initially display 116 letters to be used in the creation of the solution words.

The user is prompted to choose a solution word 430 to create. By identifying the solution word identifier, the user is allowed to input a solution word which begins with the letter assigned to that solution word identifier. As the user inputs the solution word, the letters used to create the solution word are removed from the letter bank. As illustrated in FIG. 7, the letter bank display is refreshed so that, at all times, the user is aware of how many letters, and which letters, may be used to create the solution words. With reference to FIGS. 5*a*–5*c*, if a user wished to enter the word "TIPTOE" as the solution word identified by the solution word identifier "I", the letter bank would decrease by five letters. The used set "IPTOE" would be removed from the letter bank and the refreshed letter bank display would indicate the number of letters remaining in the letter bank. This process is repeated until all of the solution words have been created and there are exactly zero remaining letters in the letter bank as shown in FIG. 8.

As an added feature, the program of the present invention allows the user to "go into the hole" when creating solution words. While creating a solution word, if a letter not contained in the letter bank is used, the letter bank will reflect a negative number. Other programs which allow the creation of double crostic puzzles by computer do not provide such a feature. When using the ENIGMACROSS™© program, for example, the user is not allowed to create solution words out of letters that are no longer in the letter bank. This makes it more difficult to create double crostic puzzles because the user must constantly delete solution words in order to refill the letter bank. The letter bank of the present invention, however, is not as rigid as the other existing programs. A time saving advantage is thus provided since the user can create all of the solution words, go "into the whole" with certain letters, and then adjust the words as necessary to zero out the letter bank. In addition, the letter bank letters which are represented by negative numbers (or "in the hole" values) may be highlighted in the solution words so that a solution word containing the most "in the hole" letters can be changed, thereby refreshing and repopulating the letter bank.

As the letters are pulled from the letter bank, the program notes the index number assigned to the letter. This information is stored to keep track of the letters in the solution words which correspond with the letters in the messages 600 and 610. Although not necessarily visible to the user, the index number information is stored so that if the double crostic puzzle is printed or displayed in an unsolved state, it will be represented, as shown in FIGS. 4*a*–4*c*. Likewise, the solution word identifier associated with each letter used from the letter bank is stored. This provides a cross-reference solution word identifier for each letter of messages 600 and 610 when printed in a format like that shown in FIGS. 4*a*–4*c*.

After all of the solution words have been entered and the letter bank is emptied, the user is prompted to enter the clues for the solution words. Clues may be entered in order or randomly. For example, to enter the clue "Walk noiselessly or carefully" for the solution word "TIPTOE" represented by the solution word identifier "I" in FIGS. 5*a*–5*c*, the user would select the solution word identifier "I" and then input the clue. This step is repeated for each solution word until clues for all of the solution words have been created.

Once creation of the double crostic puzzle is complete, the user may save the puzzle or opt to print out a hard copy of the puzzle. If a hard copy is printed, both the solution and an encrypted version may be printed, as illustrated in FIGS. 4*a*–*c* and 5*a*–5*c*.

The Double Crostic Puzzle Solver

The computer program of the present invention may also be used to solve double crostic puzzles which have been created using the program. The double crostic puzzle solver loads a saved double crostic puzzle into the memory of the computer or provides access to the necessary data files. A graphical display appears on the output device of the computer depicting the chosen double crostic puzzle for solution.

Figure 9:
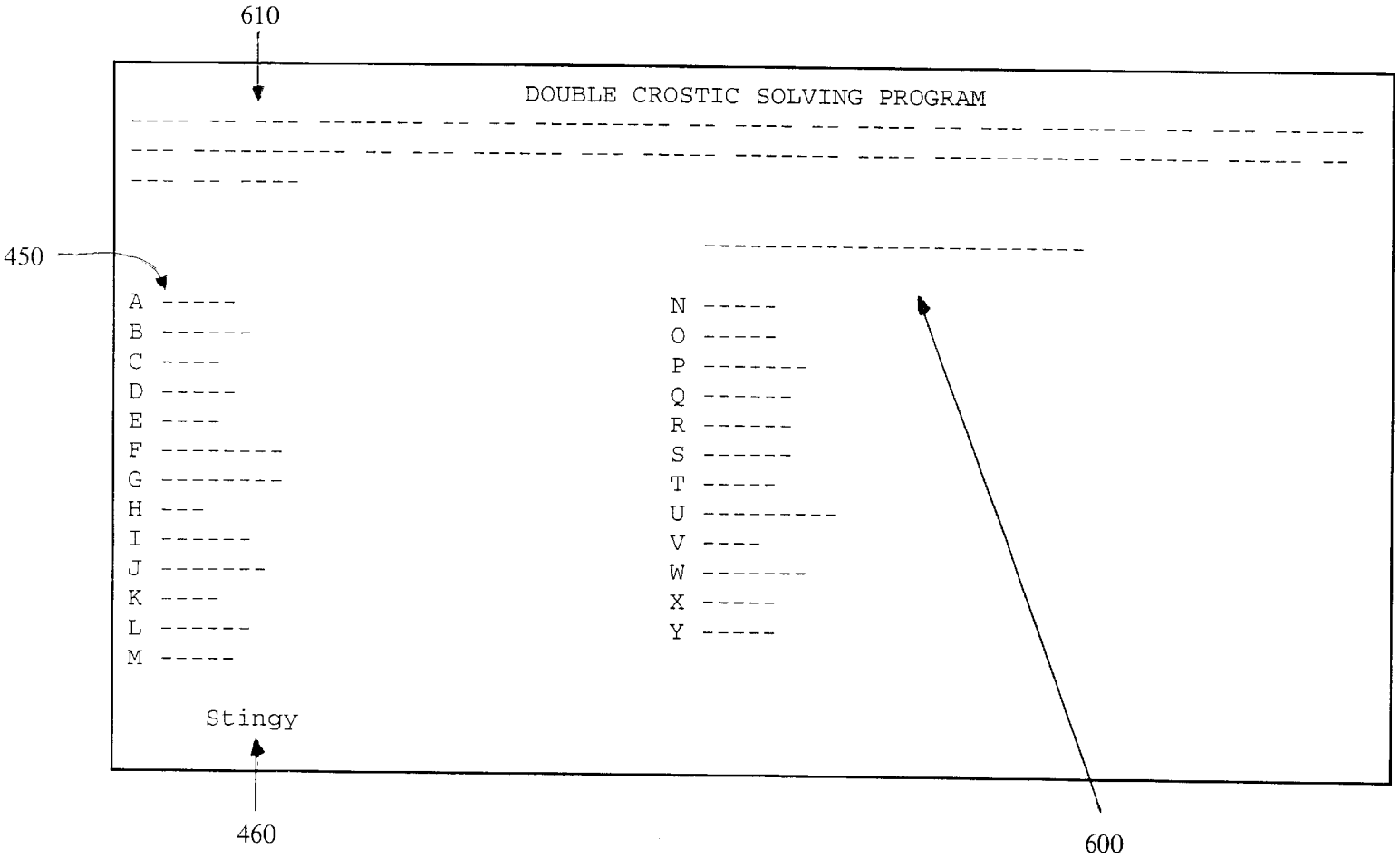
FIG. 9 illustrates the double crostic puzzle solver of the present invention.

The graphical display presents a set of letter lines representing the first message 610 and a set of letter lines representing the second message 610 in an encrypted state, as illustrated in FIG. 9. In addition, the solution words are represented by letter lines and the clue for the solution word upon which the cursor is located is displayed at the bottom of the screen. In FIG. 9, the cursor 450 is displayed on the first letter line of the encrypted solution word represented by the solution word identifier "A". In that example, the clue 460 "STINGY" appears at the bottom of the screen. Alternatively, the clues for the solution words may also be displayed next to the corresponding solution words. It is understood that the index numbers and solution word identifiers need not be displayed with the letter lines, since the computer program keeps track of such information and automates the process for the user. As letters are entered into the letter lines of the solution words or the letter lines of the messages, the corresponding letters also appear in the double crostic puzzle.

Figure 10:
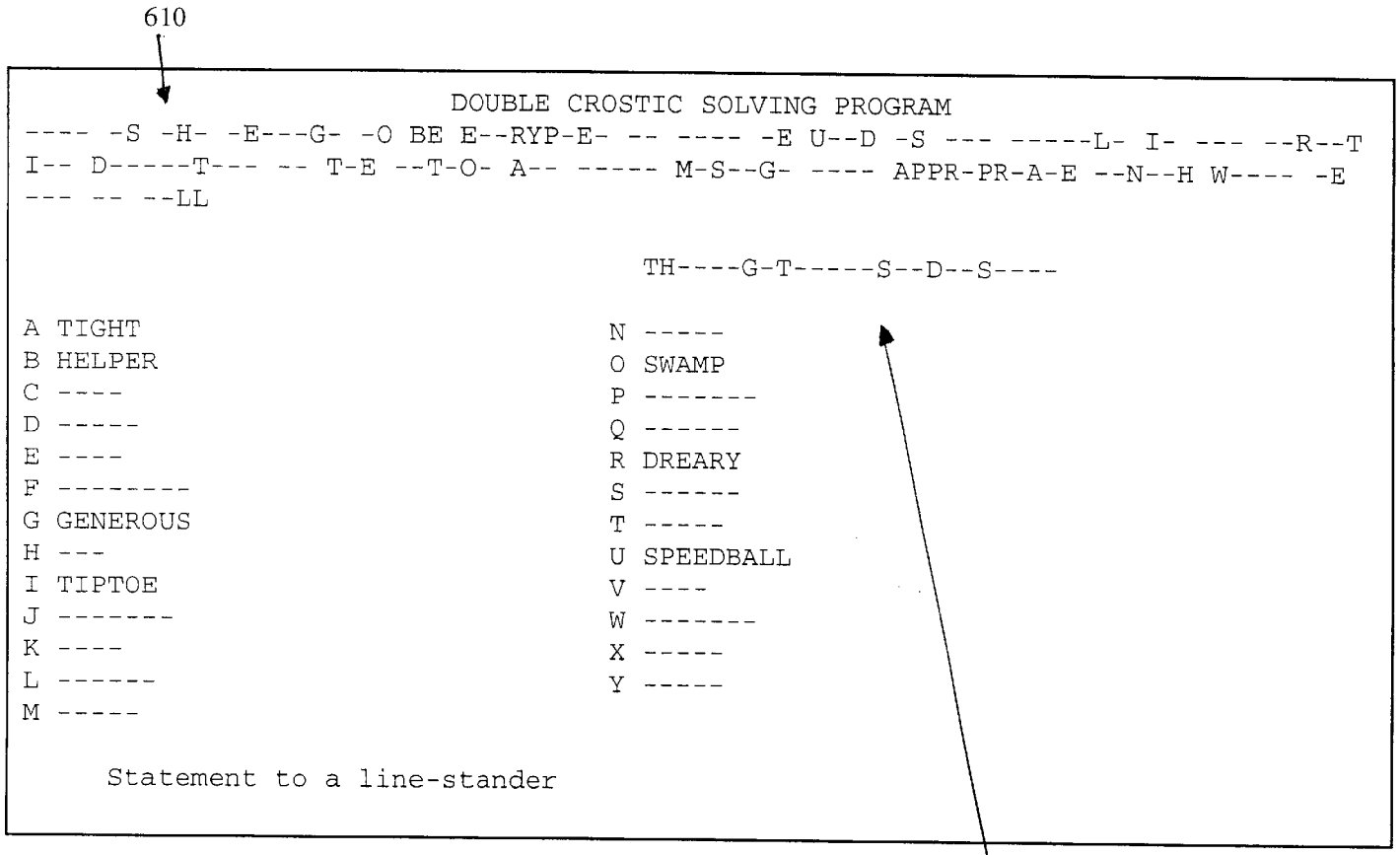
FIG. 10 illustrates a partially solved double crostic puzzle using the present invention.

Referring to FIG. 10, a partially solved puzzle is shown. Each of the letters visible in the solution words are also visible in the letter lines of the encrypted messages 600 and 610. For each visible letter in the solution words, there exists a corresponding visible letter in the second message 610. Alternatively, where it is desirable to show the index numbers, solution word identifiers, or both, these may be displayed as well. If a hard copy printout of the double. crostic puzzle being solved is printed, the index numbers and solution word identifiers can be printed, as illustrated in FIGS. 4*a*–4*c*.

The solution of the double crostic puzzle is complete when all of the solution words are properly identified and the encrypted messages 600 and 610 are revealed.

The Double Crostic Solitaire Game

Figure 11:
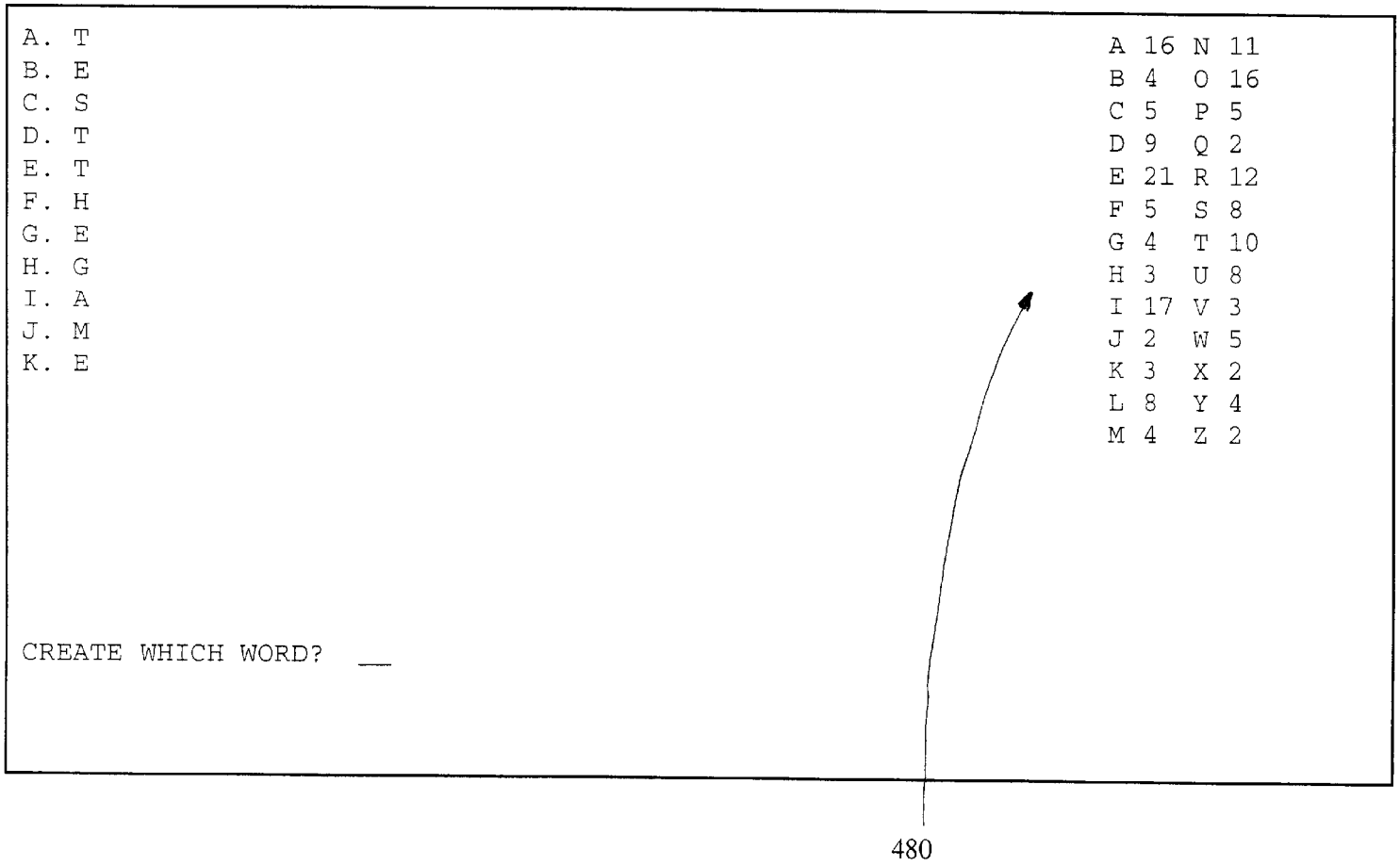
FIG. 11 illustrates the beginning of a double crostic solitaire game of the present invention.

Referring to FIG. 11, a double crostic solitaire game is illustrated. The definition of solitaire for the purposes of this disclosure is a game that may be played by a single user. In the double crostic solitaire game, the computer program prompts the user for a single message and then converts each letter of the message into the first letter of a solution word. This is similar to the conversion of the first message 600 into the solution words as explained with reference to the double crostic puzzle creator portion of the program. The set of first letters for the solution words is then displayed along with solution word identifiers. A letter bank, similar to the one already described, is also displayed.

Figure 12:
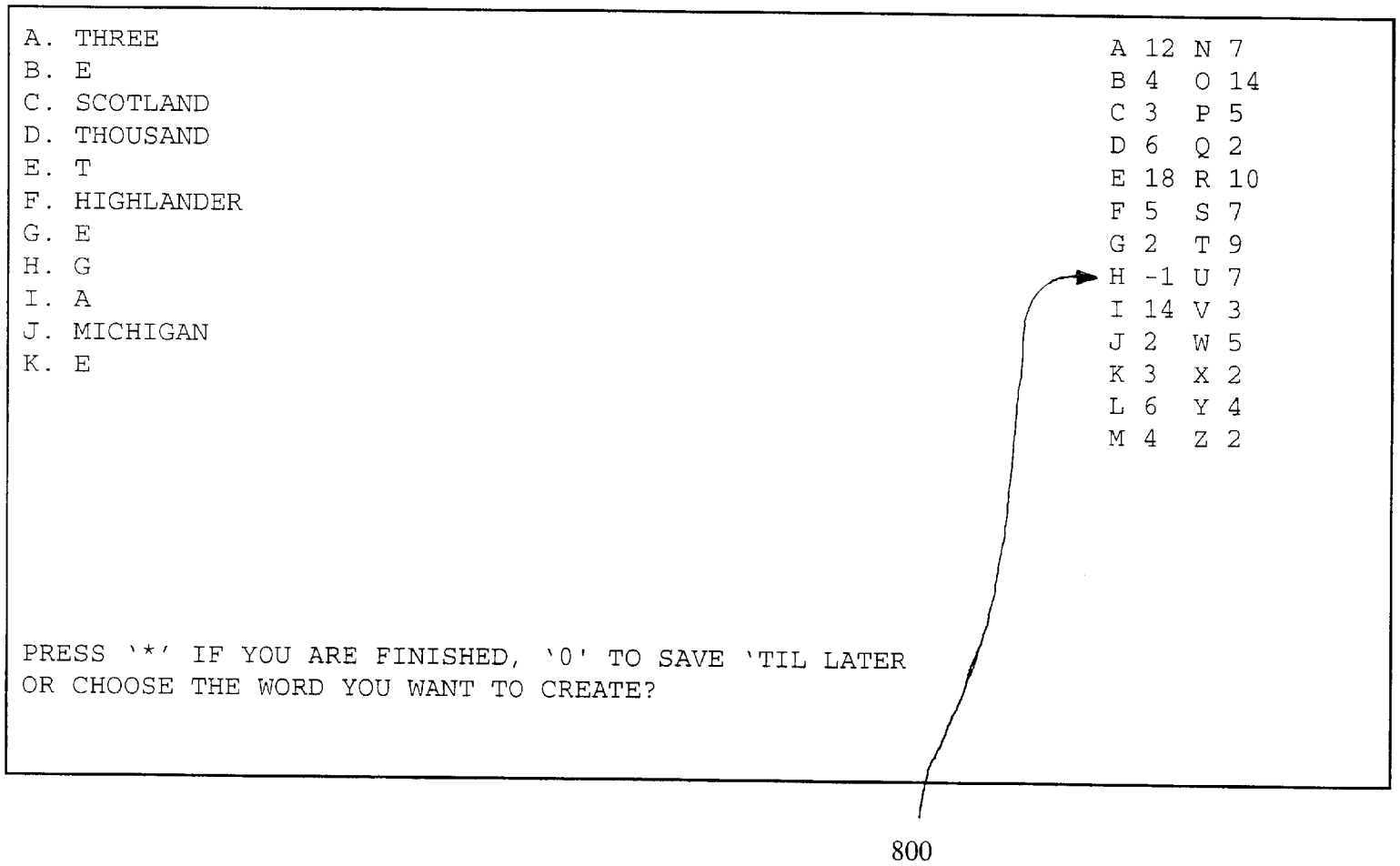
FIG. 12 illustrates a partially solved solitaire game of the present invention in which the letter "H" in the letter bank is "in the hole"

During the operation of the double crostic solitaire game, solution words for each of the identified solution letters are created from a standard letter bank 480. The letter bank may be one of many stored in electronic format, or may alternatively be defined by the user prior to beginning the solitaire game. The double crostic solitaire game functions and operates in a similar manner to the double crostic puzzle creator, except that a double crostic puzzle is never really created. Instead, the solitaire game requires the user to use all of the letters in a predefined letter bank to create the set of solution words corresponding to the letters of the message entered by the user. Like the double crostic creation program, the double crostic solitaire program allows the user to "go into the hole" while creating the solution words and highlight any letters in the solution words which may be removed to bring the user "out of the hole." FIG. 12 illustrates a partially solved solitaire game in which the user has gone "in the hole" 800 on letter "H".

Having thus described certain preferred embodiments of the present invention, it is to be understood that the invention defined by the appended claims is not to be limited by particular details set forth in the above description, as many apparent variations thereof are possible without departing from the spirit or scope thereof as hereinafter claimed.

What is claimed is:

1. A method of creating a double crostic puzzle utilizing a computer having a processor, a memory, a storage device, at least one input device, and at least one output device, said method comprising:

retrieving a first message comprising a finite number of first message letters;

retrieving a second message comprising a finite number of second message letters;

ensuring that said first message letters are a subset of said second message letters;

creating a letter bank from said second message comprising said second message letters;

identifying a set of solution word first letters comprising said first message letters;

removing each of said first message letters from said letter bank;

retrieving a set of solution words corresponding to said set of solution word first letters from said at least one input device;

removing each letter in said set of solution words from said letter bank as said set of solution words are retrieved;

displaying a negative number for any letter used in said set of solution words more than the number of times it appears in said letter bank, wherein said negative number reflects the difference between the number of times said particular letter appears in said second message letters and the number of times a particular letter appears in said set of solution words; and retrieving a set of solution word clues from said at least one input device.

2. The method of claim 1, further including storing said first message, said second message, said set of solution words, and said set of solution word clues on a storage medium using said storage device.

3. The method of claim 2, wherein said storage medium is a storage medium consisting of a floppy disk, an optical disk, a hard disk drive, a compact disc, and a dvd disk.

4. The method of claim 1, further comprising:

counting the number of letters in said first message;

counting the number of letters in said second message;

calculating a solution word average length number by dividing the number of letters in said second message by the number of letters in said first message; and displaying said solution word average length number on said at least one output device.

5. The method of claim 1, wherein retrieving a set of solution words from at least one input device comprises:

prompting a user to create a solution word;

retrieving a solution word from said input device; and displaying said solution word on said output device.

6. A method of creating an double crostic puzzle utilizing a computer having a processor, a memory, a storage device, at least one input device, and at least one output device, said method comprising:

retrieving a first message from said input device, said first message having a finite number of letters;

retrieving a second message from said input device, said second message having a finite number of letters;

creating a set of solution word letters, said set of solution word letters corresponding to said finite number of letters in said first message;

assigning a solution word identifier to each of said solution word letters;

displaying said set of solution word letters and corresponding solution word identifiers on said at least one output device;

creating a letter bank, said letter bank comprising each of said letters of said second message;

displaying said letter bank on said at least one output device;

retrieving a solution word for at least one solution word identifier wherein said solution word begins with said solution word letter corresponding to said at least one solution word identifier;

removing each letter of said retrieved solution word from said letter bank, wherein any letter of said retrieved solution word not in said letter bank is displayed in said letter bank as a negative value corresponding to said letter; and retrieving a solution word clue for each said solution word.

7. The method of claim 6, wherein creating a letter bank comprises:

creating a two dimensional array in said memory, wherein said array holds two sets of values, one set of values in a first dimension and a second set of values in a second dimension;

assigning each letter of the alphabet to exactly one of the values of the first dimension of said array;

counting the number of times each letter of the alphabet occurs in said second message; and storing the numerical value of said counting in the second dimension of the array corresponding to said letter stored in said first dimension of said array.

8. The method of claim 7, wherein displaying said letter bank on said at least one output device comprises:

displaying on said at least one output device said first dimensional value; and displaying next to said displayed first dimensional value a numerical value equal to the difference between said second dimensional value corresponding to said first dimensional value and a number of times that a letter corresponding to said first dimensional value appears in said solution words for each of said array values.

9. The method of claim 6, wherein displaying said letter bank on said at least one output device comprises:

displaying all of the letters from said second message which are not used in said solution words; and displaying negative values for any letters overused in said solution words.

10. The method of claim 6, wherein retrieving a solution word for at least one solution word identifier is repeated until each of said solution word identifiers correspond to a solution word.

11. The method of claim 10, wherein said repetition of retrieving said solution word for each of said solution word identifiers is complete when said letter bank has exactly zero letters and no said negative values.

12. The method of claim 10, wherein said displaying said letter bank on said at least one output device displays negative numbers.

13. The method of claim 6, wherein retrieving a solution word for at least one solution word identifier comprises:

prompting a user to select a solution word identifier corresponding to the solution word said user desires to create, said prompt appearing on said at least one display device;

retrieving said solution word identifier from said at least one input device;

prompting said user to enter a solution word beginning with the solution word letter corresponding to said selected solution word identifier, said prompt appearing on said at least one display device;

retrieving said solution word, said solution word having a finite number of letters; and displaying said solution word on said at least one output device.

14. The method of claim 6, further comprising highlighting any solution word containing a letter corresponding to any said negative value in said letter bank.

15. A method of playing a solitaire word game utilizing a computer having a processor, a memory, at least one input device, and at least one output device, said method comprising:

retrieving a message from said first input device, said message comprising a finite number of letters;

forming a set of undeciphered solution words from said message, each undeciphered solution ord of said set of undeciphered solution words having a first letter corresponding to exactly one of said finite number of letters of said message;

displaying each undeciphered solution word and said first letter on said at least one output device;

retrieving a predefined letter bank unrelated to said message, said letter bank comprising a finite number of letters; and prompting the input of a solution word in place of one of said undeciphered solution words, said solution word beginning with said first letter of said undeciphered solution word.

16. The method of claim 15, wherein retrieving said letter bank comprises retrieving said letter bank from said memory of said computer.

17. The method of claim 16, wherein retrieving said letter bank comprises prompting a user to input a letter bank using said at least one input device.

18. A method for creating a double crostic puzzle from two messages utilizing a computer program, wherein solution words beginning with letters from a first message are formed from letters in a letter bank consisting of letters from a second message, comprising:

allowing a use of letters not in the letter bank for the temporary formation of solution words.

* * * * *